US009044772B2

(12) United States Patent
Maekawa

(10) Patent No.: US 9,044,772 B2
(45) Date of Patent: Jun. 2, 2015

(54) WATER APPLICATION UNIT FOR AUTOMATICALLY APPLYING WATER ONTO SHEET BEING TRANSFERRED

(71) Applicant: Riso Kagaku Corporation, Tokyo (JP)

(72) Inventor: Akinori Maekawa, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 45 days.

(21) Appl. No.: 13/869,184

(22) Filed: Apr. 24, 2013

(65) Prior Publication Data

US 2013/0284085 A1 Oct. 31, 2013

(30) Foreign Application Priority Data

Apr. 26, 2012 (JP) ..... 2012-100803

(51) Int. Cl.

| | |
|---|---|
| ***B05C 1/02*** | (2006.01) |
| ***B43M 11/06*** | (2006.01) |
| ***B43M 5/04*** | (2006.01) |
| ***B43M 11/00*** | (2006.01) |
| ***B43M 11/04*** | (2006.01) |
| *B41L 7/00* | (2006.01) |
| *B41L 7/08* | (2006.01) |

(52) U.S. Cl.

CPC ... *B05C 1/02* (2013.01); *B41L 7/00* (2013.01); *B43M 11/06* (2013.01); *B41L 7/08* (2013.01); *B43M 5/04* (2013.01); *B43M 11/00* (2013.01); *B43M 5/047* (2013.01); *B43M 11/04* (2013.01)

(58) Field of Classification Search

CPC ..... B05C 1/02; B05C 1/022; B05C 1/025; B05C 1/027; B43M 5/04; B43M 5/042; B43M 5/045; B43M 5/047; B43M 11/04; B43M 11/06; G01N 30/91

USPC ..... 118/264, 268, 269; 156/441.5

See application file for complete search history.

(56) References Cited

U.S. PATENT DOCUMENTS

| | | | | | |
|---|---|---|---|---|---|
| 2,484,986 | A | * | 10/1949 | Ellinger | 15/229.13 |
| 2,564,842 | A | * | 8/1951 | Helmuth | 118/200 |
| 3,000,349 | A | * | 9/1961 | Ritzerfeld et al. | 118/264 |
| 4,643,123 | A | * | 2/1987 | Auerbach | 118/32 |
| 5,531,828 | A | * | 7/1996 | Whang | 118/264 |

FOREIGN PATENT DOCUMENTS

JP 2012-045754 A 3/2012

* cited by examiner

*Primary Examiner* — Laura Edwards

(74) *Attorney, Agent, or Firm* — Nath, Goldberg & meyer; Jerald L. Meyer; Tiffany A. Johnson

(57) ABSTRACT

A water application unit includes a reservoir configured to pool water and a water application pad configured to apply the water pooled in the reservoir onto a remoistenable glue portion previously attached to an adhesion position on a sheet being transferred. The water application pad includes a first pad member disposed at a position to be immersed in the reservoir and including first pores for sucking up the water in the reservoir and a second pad member disposed at a position to face the remoistenable glue portion while being in contact with the first pad member and including second pores for applying the water onto the remoistenable glue portion. The second pores has a diameter larger than a diameter of the first pores.

2 Claims, 14 Drawing Sheets

WATER APPLICATION UNIT FOR AUTOMATICALLY APPLYING WATER ONTO SHEET BEING TRANSFERRED

CROSS REFERENCE TO RELATED APPLICATION

This application is based upon and claims the benefit of priority from the prior Japanese Patent Application No. 2012-100803, filed on Apr. 26, 2012, the entire contents of which are incorporated herein by reference.

BACKGROUND

1. Technical Field

The present disclosure relates to a water application unit for automatically applying water onto a sheet being transferred.

2. Related Art

In general, in the case where a sender sends a large number of various documents, direct mails or the like to a large number of receivers by mail in an envelope, an envelope sheet is folded up into an envelope shape and automatically sealed, or the flap portion of an envelope is folded up and automatically sealed.

At this time, a remoistenable glue portion is previously attached to a predetermined adhesion position on the sheet such as the envelope sheet or the envelope, in some cases. The remoistenable glue portion is used for automatic adhesion of the predetermined adhesion position on the sheet.

The remoistenable glue portion is formed with an adhesive material such as mucilage, and water is automatically applied onto this remoistenable glue portion by a water application unit configured to wet the remoistenable glue portion for adhesion.

Meanwhile, various sealing devices for automatically sealing envelopes are proposed. For example, Japanese Patent Application Publication No. 2012-45754 proposes a sealing device provided with a water application unit configured to apply water onto a remoistenable glue portion previously attached to a flap portion of the envelope, while sliding the envelope in one direction by a guide unit.

Although illustration is omitted herein, the water application unit provided in the sealing device disclosed in Japanese Patent Application Publication No. 2012-45754 includes: a reservoir pooling water; and a moisturizing unit which is made of, for example, a wound nonwoven fabric, a sponge, or the like capable of absorbing water by capillary action, and which is immersed in the reservoir and provided to be capable of facing a remoistenable glue portion previously attached to a flap portion of an envelope.

The envelope is sealed by automatically applying water by the moisturizing unit of the water application unit onto the remoistenable glue portion previously attached to the flap portion of the envelope while sliding the envelope in one direction on the guide unit.

SUMMARY

The water application unit provided in the sealing device disclosed in Japanese Patent Application Publication No. 2012-45754 uses a sponge or a wound nonwoven fabric as the moisturizing unit. For this reason, although it is possible to suck up water in the reservoir by capillary action, how water is sucked up by capillary action varies depending on the material of the moisturizing unit.

For example, a sponge made of polyurethane resin or the like having a continuous porous structure and including multiple fine pores may be used as the moisturizing unit.

When a sponge with a small pore size is used as the moisturizing unit, although it can efficiently suck up water in the reservoir by capillary action, it can only suck up a small amount of water. Hence, only a small amount of water is applied to the remoistenable glue portion.

Moreover, when the moisturizing unit with a small pore size is used to apply water to the remoistenable glue portion, a phenomenon occurs in which the water applied to the remoistenable glue portion is returned to the moisturizing unit at the point when the moisturizing unit separates from the remoistenable glue portion. Hence, the amount of water applied to the remoistenable glue portion is reduced even more.

In contrast, when a sponge with a large pore size is used as the moisturizing unit, although it can suck up a large amount of water from the reservoir, the action of sucking up by capillary is made less efficient because of gravity. Hence, water does not smoothly reach the water application portion of the moisturizing unit, and an appropriate amount of water cannot be applied onto the remoistenable glue portion.

Specifically, when only a single type of sponge is used as the moisturizing unit, a first function of surely sucking up water in the reservoir and a second function of applying an appropriate amount of water onto the remoistenable glue portion cannot be satisfied at the same time.

The invention aims to provide a water application unit capable of satisfying both the first function of surely sucking up water from a reservoir and the second function of applying an appropriate amount of water to a remoistenable glue portion at the same time, when automatically applying water to the remoistenable glue portion previously attached to a predetermined adhesion position on a sheet, while transferring a sheet such as an envelope sheet that can be folded up into an envelope shape or an envelope with a flap portion.

A water application unit in accordance with some embodiments includes a reservoir configured to pool water and a water application pad configured to apply the water pooled in the reservoir onto a remoistenable glue portion previously attached to an adhesion position on a sheet being transferred. The water application pad includes a first pad member disposed at a position to be immersed in the reservoir and including first pores for sucking up the water in the reservoir and a second pad member disposed at a position to face the remoistenable glue portion while being in contact with the first pad member and including second pores for applying the water onto the remoistenable glue portion. The second pores has a diameter larger than a diameter of the first pores.

According to the above configuration, the first pad member including the first pores having small diameter surely sucks up the water in the reservoir and the second pad member including the second pores having large diameter receives the water sucked up by the first pad member and applies the water onto the remoistenable glue portion. Thus, at least the second pad member can automatically apply an appropriate amount of water onto the remoistenable glue portion.

As a result, the water application pad in which the first and second pad members are allowed to contact each other can satisfy both the first function of surely sucking up the water in the reservoir, and the second function of applying an appropriate amount of water onto the remoistenable glue portion. The water application pad can thus surely apply an appropriate amount of water onto the remoistenable glue portion.

When applying the water onto the remoistenable glue portion by the water application pad, an end of the first pad member for applying the water onto the remoistenable glue portion may be separated from the remoistenable glue portion, while an end of the second pad member for applying the water onto the remoistenable glue portion may come in contact with the remoistenable glue portion.

According to the above configuration, an appropriate amount of water can be automatically applied onto the remoistenable glue portion by the second pad member.

The water application unit further includes a pad sandwiching plate configured to sandwich and hold the first pad member and the second pad member, and arranged with a space from the water application pad at a portion toward an end of the water application pad for applying the water onto the remoistenable glue portion.

According to the above configuration, water splashed from the remoistenable glue portion does not wet the sheet surrounding the remoistenable glue portion or the sheet transfer path in the water application unit, and thus does not affect the transfer of the sheet. Moreover, the extra water splashed from the remoistenable glue portion can be returned to the reservoir via the spaces described above.

DETAILED DESCRIPTION

Figure 1:
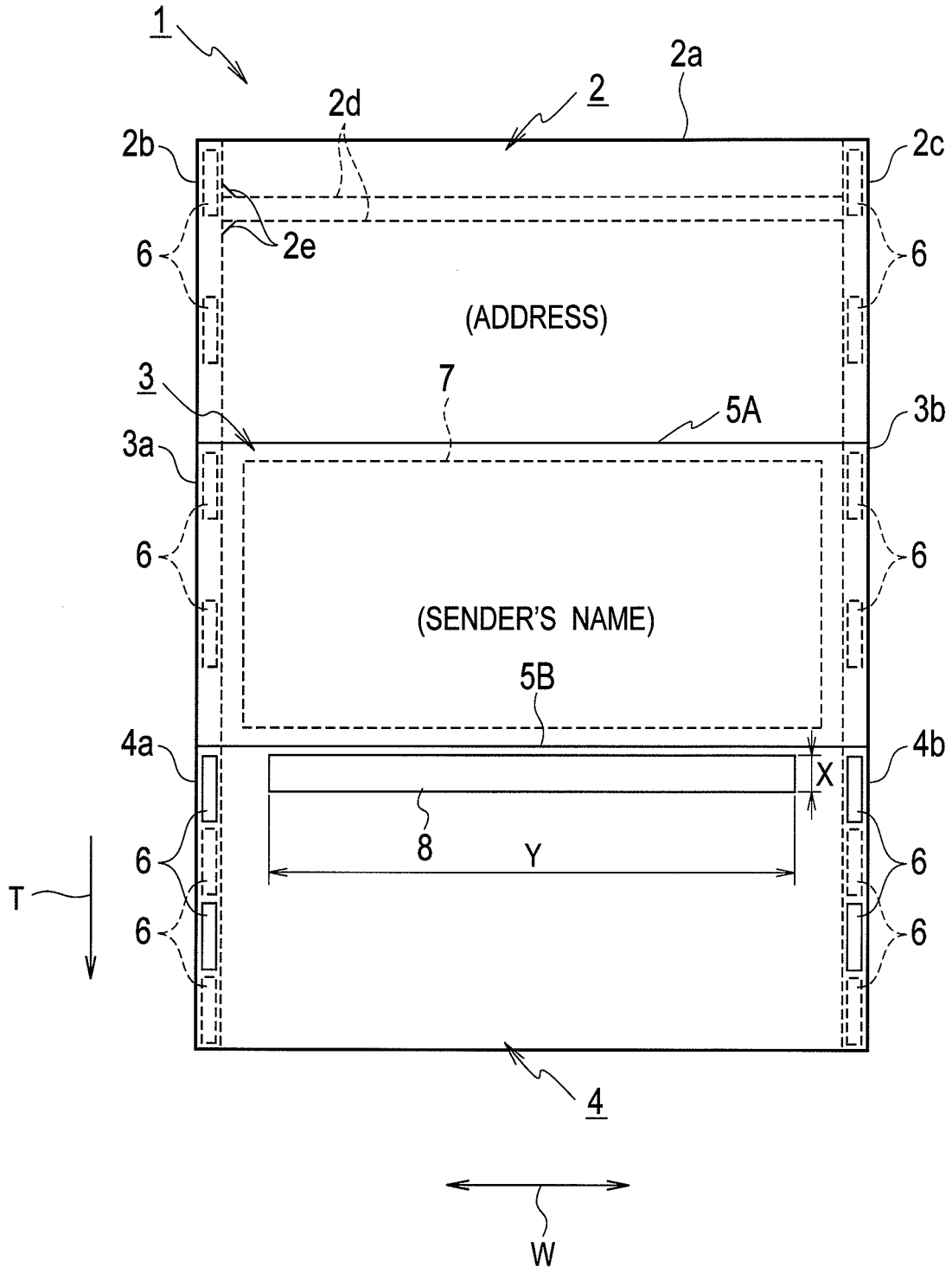
FIG. 1 is a plan view for describing an envelope sheet used in a water application unit of an embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Hereinafter, a detailed description is given of a water application unit of an embodiment of the invention with reference to FIGS. 1 to 14.

The water application unit of the embodiment of the invention is characterized by including: a reservoir for pooling water to be automatically applied to a remoistenable glue portion previously attached to a predetermined adhesion position on a foldable envelope sheet or an envelope with a flap portion while the sheet is being transferred; and a water application pad having a first function of surely sucking up water in the reservoir, and a second function of applying an appropriate amount of water to the remoistenable glue portion.

Before explaining the water application unit of the embodiment of the invention, a description is firstly given of the envelope sheet used in the water application unit by referring to FIGS. 1 and 2.

Figure 2A:
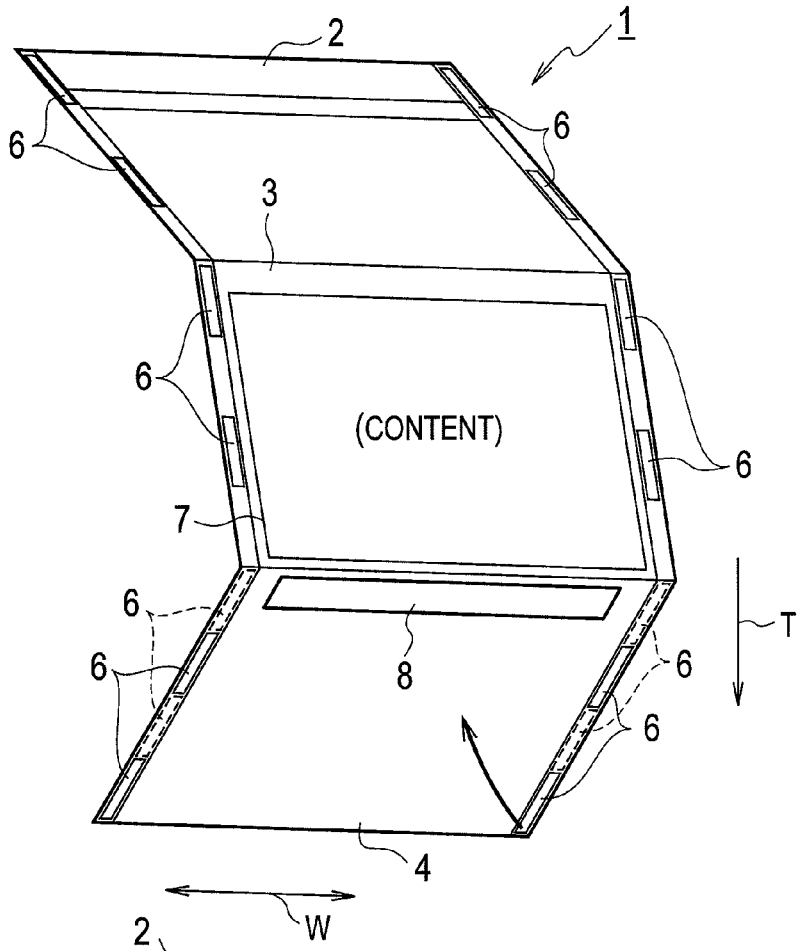
FIGS. 2A and 2B are perspective views for describing how the envelope sheet shown in FIG. 1 is folded up into an envelope shape.
Figure 2B:
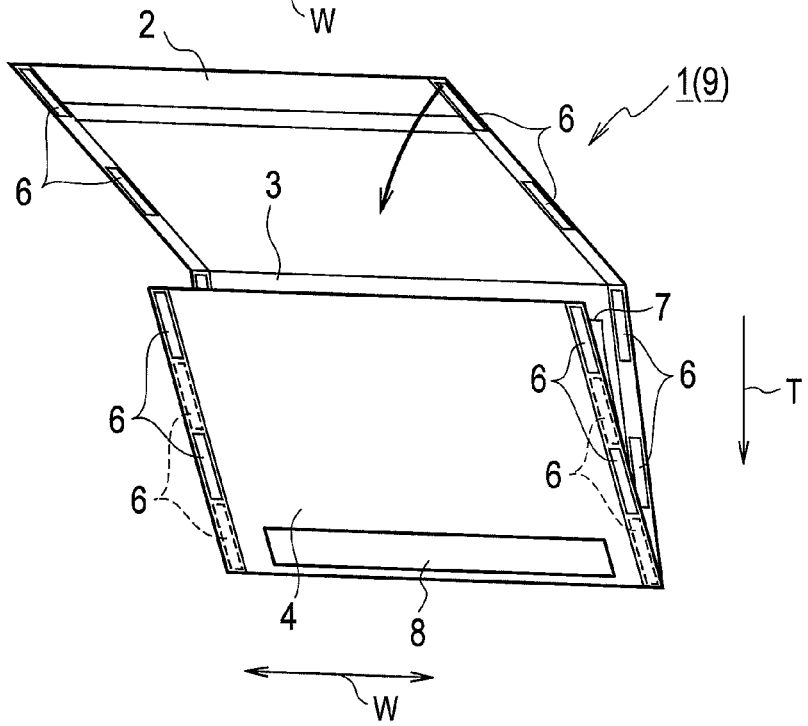

FIG. 1 is a plan view of the envelope sheet used in a water application unit 70 of the embodiment of the invention, and FIGS. 2A and 2B are perspective views showing how the envelope sheet shown in FIG. 1 is folded up into an envelope shape.

Firstly, as shown in FIG. 1, an envelope sheet 1 as an example of a sheet used in the water application unit 70 (FIGS. 3 and 5 to 8) of the embodiment of the invention is formed of an envelope upper paper 2, an envelope middle paper 3, and an envelope lower paper 4 joined together. The envelope sheet 1 is folded up in thirds by folding the envelope upper paper 2, the envelope middle paper 3, and the envelope lower paper 4 at creases 5A and 5B to form an envelope 9 (FIGS. 2 and 3), which can be sealed by adhesion.

At this time, a direction in which the envelope sheet 1 is transferred is referred to as a sheet transfer direction, and a direction perpendicular to the sheet transfer direction is referred to as a sheet width direction. In some parts of the description, the front and rear of the sheet transfer direction are referred to by calling the rear side of the sheet transfer direction the upstream side, and the front side of the sheet transfer direction the downstream side. Likewise, both sides of the sheet width direction are called left and right of the sheet width direction.

In the envelope upper paper 2, an address is printed on a front face thereof, and strip-shaped perforations for opening 2*d* are formed on its front end 2*a* side between left and right sides 2*b* and 2*c*. Finger insertion openings 2*e* are formed in the left end of the perforations for opening 2*d*, so that after the envelope is sealed, a receiver can open it by inserting his/her fingers in the finger insertion openings 2*e* and tearing the perforations for opening 2*d*. In addition, on the rear face of the envelope upper paper 2, a pressure-sensitive adhesive 6 is provided in strip shapes at predetermined intervals on the left and right sides 2*b* and 2*c* thereof.

In the envelope middle paper 3, a sender's name is printed as needed on a front face thereof, and either a printed content 7 is attached as needed to its rear surface, or information is directly printable on its rear face. In addition, on the rear face of the envelope middle paper 3, the pressure-sensitive adhesive 6 is provided in strip shapes at predetermined intervals on left and right sides 3*a* and 3*b* thereof.

In the envelope lower paper 4, a strip-shaped remoistenable glue portion 8 is previously attached along the sheet width direction, on a predetermined adhesion position provided on the front face of the envelope lower paper 4 near the crease 5B. In addition, on the front and rear faces of the envelope lower paper 4, the pressure-sensitive adhesive 6 is provided in strip shapes at predetermined intervals on left and right sides 4*a* and 4*b* thereof.

Here, an adhesive material such as natural rubber is used as the pressure-sensitive adhesive 6 provided on left and right sides of the respective papers 2 to 4. When the envelope sheet 1 is folded up in thirds, the opposing portions of the pressure-sensitive adhesive 6 are brought into intimate contact with each other, a predetermined pressure is applied by later-mentioned pairs of envelope press-fit rollers 112 (FIG. 5), and the papers 2 to 4 can thereby be adhered to each other. Meanwhile, an adhesive material such as mucilage is used as the remoistenable glue portion 8. In the course of transferring the envelope sheet 1, water 75 (FIGS. 5, 6 and 8) is applied to the remoistenable glue portion 8 previously attached to the predetermined adhesion position provided on the front face of the envelope lower paper 4 of the envelope sheet 1, by the later-described water application unit 70 (FIGS. 3 and 5 to 8). Thus, the rear face of the envelope upper paper 2 can be adhered to the front face of the envelope lower paper 4.

Here, as the outer dimension of the remoistenable glue portion 8, a short width X mm is set in the sheet transfer direction, and a long length Y mm is set along the sheet width direction.

Then, after completion of printing on the envelope sheet 1 and the content 7, the content 7 is placed on the rear face of the envelope middle paper 3 as needed as shown in FIG. 2A, and the envelope lower paper 4 is folded up toward the content 7. Thereafter, when the water 75 (FIGS. 5, 6 and 8) is applied to the remoistenable glue portion 8 by the water application unit 70 (FIGS. 3 and 5 to 8) of the embodiment of the invention, and the envelope upper paper 2 is folded up toward the envelope lower paper 4 as shown in FIG. 2B, the envelope sheet 1 is folded up in thirds to form the envelope 9. Hence, the envelope 9 is automatically sealed.

Envelope Creation System

Figure 3:
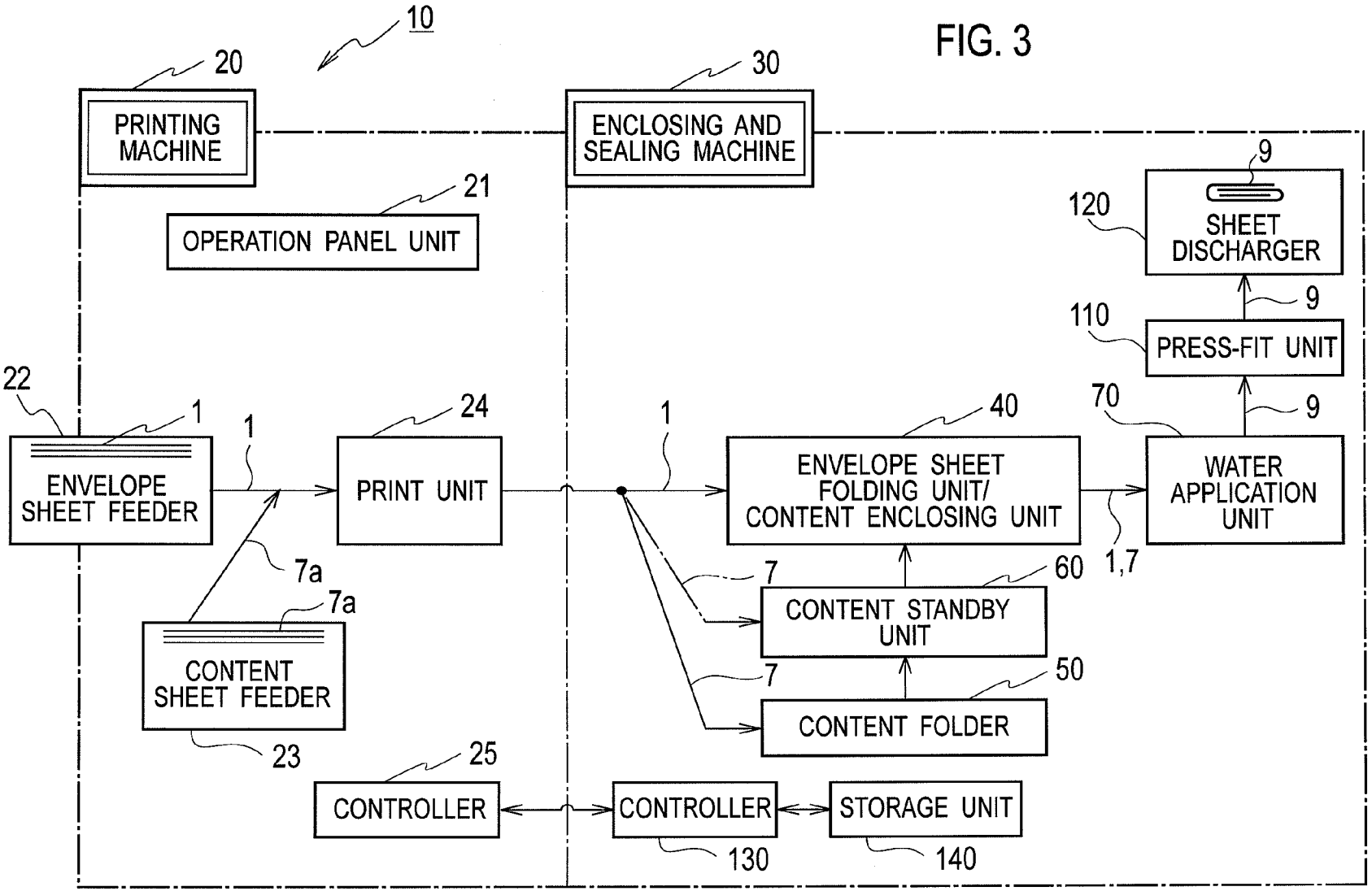
FIG. 3 is an overall configuration diagram for describing an envelope creation system to which a water application unit of the embodiment of the invention is applied.

Next, by use of FIG. 3, a description is given of an envelope creation system to which the water application unit 70 of the embodiment of the invention is applied.

Note that the following description is given using only reference numerals of components of the envelope sheet 1 in FIGS. 1 and 2, and omitting drawing numbers thereof.

FIG. 3 shows an overall configuration of the envelope creation system to which the water application unit 70 of the embodiment of the invention is applied.

As shown in FIG. 3, an envelope creation system 10 to which the water application unit 70 of the embodiment of the invention is applied is formed of: a printing machine 20 configured to selectively print the envelope sheet 1 or the content 7; and an enclosing and sealing machine 30 configured to fold the printed envelope sheet 1 into an envelope shape, enclose the printed content 7 as needed, and then adhere the envelope upper paper 2 and the envelope lower paper 4 to thereby seal the envelope 9.

The printing machine 20 includes: an operation panel unit 21 configured to input various operations for the printing motion and the enclosing and sealing motion; an envelope sheet feeder 22 configured to feed the envelope sheet 1 one at a time; a content sheet feeder 23 configured to feed a content sheet 7*a* one at a time in a case of attaching the content 7 to the envelope sheet 1 as needed; a print unit 24 configured to selectively print images and figures on the envelope sheet 1 or on the content sheet 7*a*; and a controller 25 configured to perform overall control of units in the printing machine 20.

Although details are omitted in the drawing, the operation panel unit 21 includes: a single-sided printing/double-sided printing switch key; a start key; a stop key; a numeric keypad; a copy number setting key for setting the number of copies; an alert display for displaying an alert upon occurrence of a jam or other errors; an LCD panel and the like. In addition, the operation panel unit 21 is also provided with a form information input key, for inputting form information related to the position of the remoistenable glue portion 8 which is previously attached to the envelope lower paper 4 of the envelope sheet 1.

The print unit 24 has a structural form according to an inkjet printing system, a stencil printing system, a laser printing system, a thermal transfer printing system or the like, and is capable of printing on one side or on two sides when selectively printing on the envelope sheet 1 transferred from the envelope sheet feeder 22 or on the content sheet 7*a* transferred from the content sheet feeder 23.

The enclosing and sealing machine 30 includes an envelope sheet folding unit/content enclosing unit 40, and a content folding unit 50. The envelope sheet folding unit/content enclosing unit 40 is configured to fold the envelope sheet 1 printed by the print unit 24 in the printing machine 20 in thirds to form an envelope shape, and enclose the content 7 printed as needed by the print unit 24 in the folded envelope sheet 1. The content folding unit 50 is configured to fold the content 7 printed as needed by the print unit 24.

The enclosing and sealing machine 30 further includes: a content standby unit 60, the water application unit 70, a press-fit unit 110, a sheet discharger 120, a controller 130, and a storage unit 140. The content standby unit 60 is configured to temporarily hold the content 7 printed as needed by the print unit 24 or the folded content 7. The water application unit 70 is configured to automatically apply the water 75 (FIGS. 5, 6 and 8) onto the remoistenable glue portion 8 previously attached to the predetermined adhesion position on the front face of the envelope lower paper 4 of the envelope sheet 1 folded up in the envelope shape. The press-fit unit 110 is configured to press-fit portions of the pressure-sensitive adhesive 6 provided on left and right sides of the envelope 9 folded up in the envelope shape, and to automatically seal the envelope 9. The sheet discharger 120 is configured to discharge the envelope 9 created by the water application unit 70 and the press-fit unit 110. The controller 130 is configured to perform overall control of units in the enclosing and sealing machine 30. The storage unit 140 is configured to store therein form information and the like about the envelope sheet 1, via the controller 25 of the printing machine 20 and the controller 130 of the enclosing and sealing machine 30.

At this time, the controller 25 of the printing machine 20 and the controller 130 of the enclosing and sealing machine 30 bi-directionally exchange various control signals and the like. Alternatively, the controller 130 of the enclosing and sealing machine 30 may be integrated with the controller 25 of the printing machine 20.

The storage unit 140 of the enclosing and sealing machine 30 previously stores therein information such as positional information on the predetermined adhesion position (remoistenable glue portion 8) relative to the transfer direction of the envelope sheet 1, which is set on the basis of form information on the envelope sheet 1 inputted by the form information input key (not shown) provided in the operation panel unit 21 of the printing machine 20.

Overall Operation of Envelope Creation System

Figure 4:
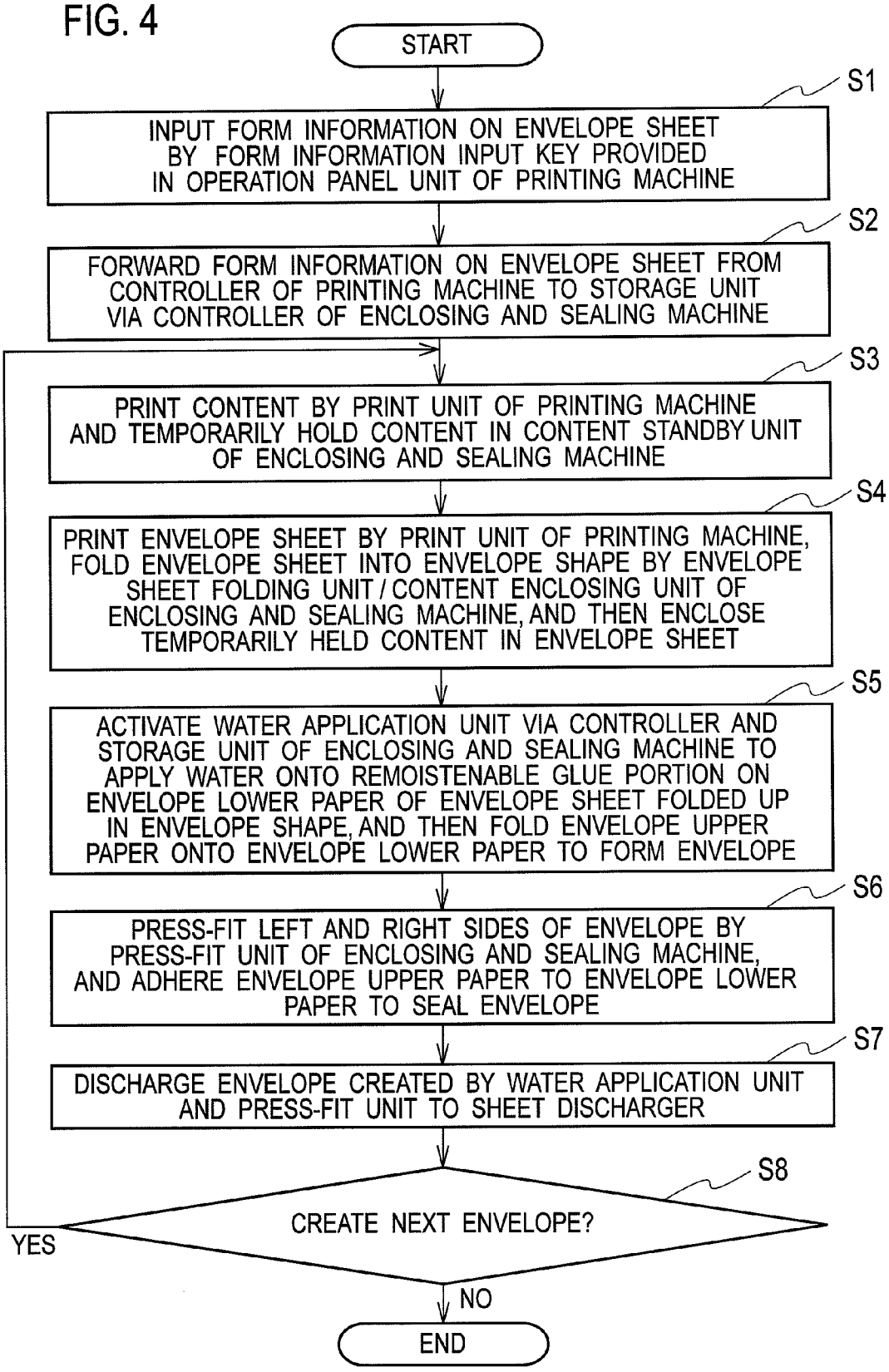
FIG. 4 is a flowchart for describing an overall operation of the envelope creation system shown in FIG. 3.

A simple description is given of the envelope creation system 10 configured in the above manner, by use of the aforementioned FIG. 3 and another drawing which is FIG. 4.

FIG. 4 shows the overall procedure for the operation of the envelope creation system, in the correct order.

As shown in FIG. 4, when the overall operation of the envelope creation system 10 is started, firstly in step S1, form information on the envelope sheet 1 is inputted by the form information input key provided in the operation panel unit 21 of the printing machine 20.

Next, in step S2, the form information on the envelope sheet 1 is forwarded from the controller 25 of the printing machine 20 to the storage unit 140 via the controller 130 of the enclosing and sealing machine 30.

Next, in step S3, the content 7 is printed by the print unit 24 of the printing machine 20, and temporarily held in the content standby unit 60 of the enclosing and sealing machine 30.

Next, in step S4, the envelope sheet 1 is printed by the print unit 24 of the printing machine 20, and folded up into an envelope shape by the envelope sheet folding unit/content enclosing unit 40 of the enclosing and sealing machine 30. Then, the temporarily held content 7 is enclosed in the envelope sheet 1.

Next, in step S5, the water application unit 70 is activated via the controller 130 and the storage unit 140 of the enclosing and sealing machine 30 to apply the water 75 (FIGS. 5, 6 and 8) onto the remoistenable glue portion 8 previously attached to the predetermined position on the front face of the envelope lower paper 4 of the envelope sheet 1 folded up in the envelope shape. Then, the envelope upper paper 2 is folded up onto the envelope lower paper 4 to form the envelope 9.

Next, in step S6, left and right sides of the envelope 9 are press-fitted by the press-fit unit 110 of the enclosing and sealing machine 30, and the envelope upper paper 2 is adhered to the envelope lower paper 4 to seal the envelope 9.

Next, in step S7, the envelope 9 created by the water application unit 70 and the press-fit unit 110 is discharged to the sheet discharger 120.

Next, it is determined in step S8 whether or not to create the next envelope 9, and if the next envelope 9 is to be created, (YES), the process returns to step S3, and if not (NO), the flow ends.

Main Components of Enclosing and Sealing Machine

Figure 5:
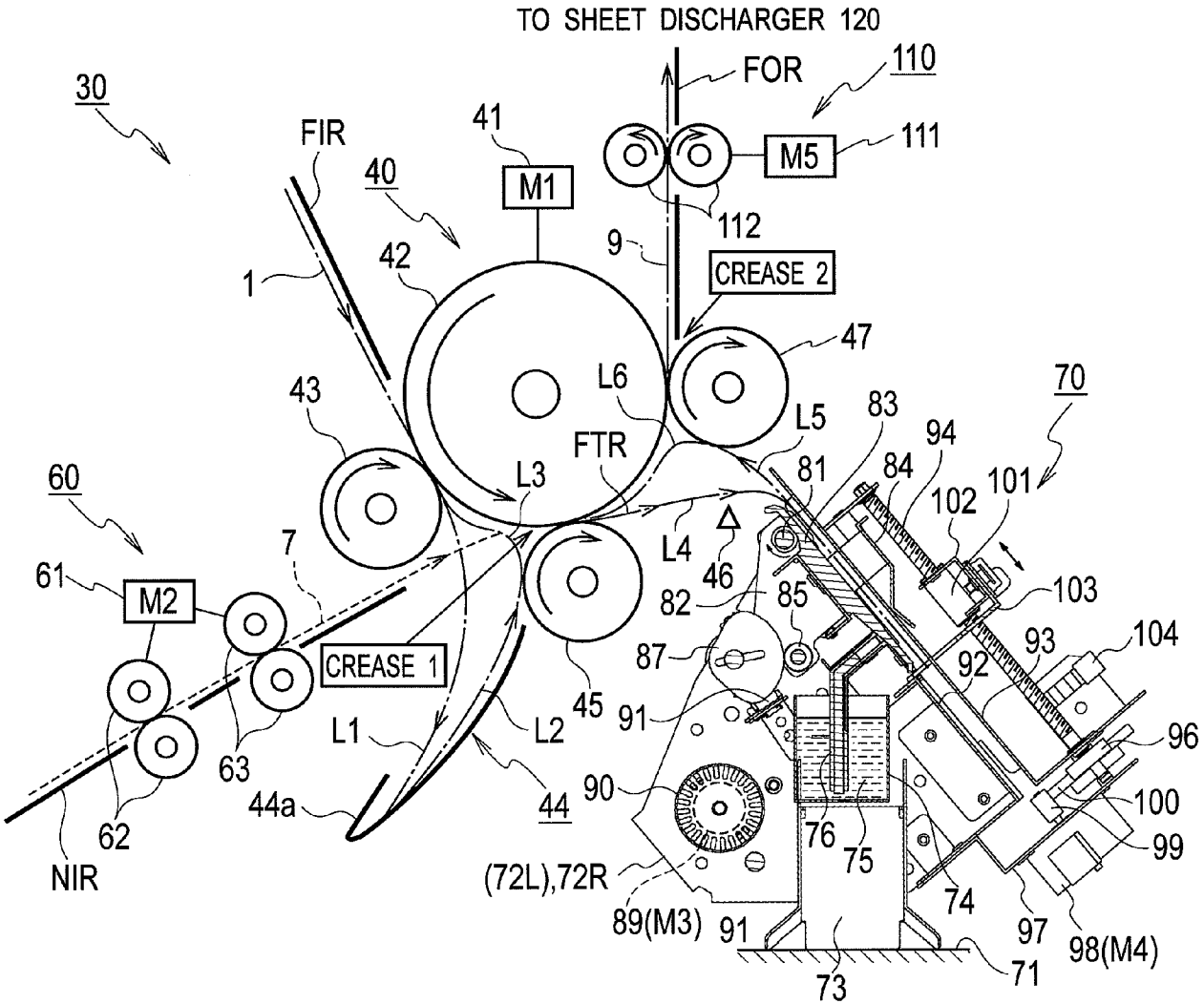
FIG. 5 is an enlarged view of main components of an enclosing and sealing machine shown in FIG. 3.

Hereinafter, details of the main components 40, 60, 70 and 110 of the enclosing and sealing machine 30 will be described with reference to FIG. 5. FIG. 5 is an enlarged view of the main components of the enclosing and sealing machine.

As shown in FIG. 5, the envelope sheet folding unit/content enclosing unit 40 of the enclosing and sealing machine 30 is provided between and substantially along an envelope sheet feed path FIR and an envelope sheet discharge path FOR, and has a function of folding the envelope sheet 1 in thirds to form an envelope shape and enclosing the content 7 as needed.

In the envelope sheet folding unit/content enclosing unit 40, a main folding roller 42 rotatable in the counterclockwise direction by the drive force of a first motor 41 is provided between and along the envelope sheet feed path FIR and the envelope sheet discharge path FOR.

A sheet conveyer roller 43 abuts the left side of the main folding roller 42 so as to be capable of being driven by the main folding roller 42, and a first sheet end plate 44 is fixedly installed below the main folding roller 42 and the sheet conveyer roller 43.

A first auxiliary folding roller 45 is provided downstream of the first sheet end plate 44 and below the main folding roller 42, while abutting the main folding roller 42 so as to be capable of being driven by the main folding roller 42. Additionally, a sheet sensor 46 is installed downstream of the first auxiliary folding roller 45, and a second auxiliary folding roller 47 abuts the right side of the main folding roller 42 so as to be capable of being driven by the main folding roller 42, above the sheet sensor 46.

Next, the content standby unit 60 is provided on the lower left side of the main folding roller 42, the sheet conveyer roller 43, and the first auxiliary folding roller 45, and has a function of temporarily holding the content 7.

In the content standby unit 60, first and second pairs of content conveyer rollers 62, 63 rotatable by the drive force of a second motor 61 are provided with a space in between along a content feed path NIR.

Here, the content feed path NIR is installed to be substantially perpendicular to the envelope sheet feed path FIR provided on the lower left side of the main folding roller 42.

When the content 7 is held, the first and second pairs of content conveyer rollers 62, 63 are suspended with the content 7 held therebetween.

Next, the water application unit 70 of the embodiment of the invention is installed on the lower right side of the first main folding roller 45, the sheet sensor 46 and the second auxiliary folding roller 47.

In the water application unit 70, a water application pad 76 formed of a sponge or the like is immersed in the water 75 pooled in a reservoir 74. The water application unit 70 has a function of automatically applying the water 75 sucked up by the water application pad 76, onto the remoistenable glue portion 8 previously attached to the predetermined adhesion position on the front face of the envelope lower paper 4 of the envelope sheet 1 being transferred.

Here, a sheet transfer path is formed inside the water application unit 70. The sheet transfer path includes: moving guide plates 83 turnable by the drive force of a third motor 89 when guiding the transfer of the lower side of the envelope sheet 1; a lower side sheet transfer guide plate 92 and an upper side sheet transfer guide plate 93 for guiding the transfer of the upper side of the envelope sheet 1 provided in parallel and downstream of the moving guide plates 83; and a second sheet end plate 103 moveable in the transfer direction of the envelope sheet 1 by the drive force of a fourth motor 98. Details of the water application unit 70 of the embodiment of the invention will be given later.

Next, the press-fit unit 110 is installed above the main folding roller 42 and the second auxiliary folding roller 47 of the envelope sheet folding unit/content enclosing unit 40, and the pairs of envelope press-fit rollers 112 rotatable by the drive force of a fifth motor 111 are provided along the envelope discharge path FOR.

The press-fit unit 110 has a function of press-fitting portions of the pressure-sensitive adhesive 6 provided on left and right sides of the envelope 9 formed by folding the envelope sheet 1 into the envelope shape, and automatically sealing the envelope 9.

Here, the pairs of envelope press-fit rollers 112 in the press-fit unit 110 are disposed such that a pair of upper and lower rollers is provided on each of the left and right sides of the envelope sheet 1 in the width direction to nip the envelope sheet 1. After folding the envelope sheet 1 into the envelope shape to form the envelope 9 and automatically sealing it, a predetermined pressure is applied to the left and right sides of the envelope 9 to press-fit the portions of the pressure-sensitive adhesive 6 provided on the left and right sides of the envelope 9. Accordingly, there is no need to apply a large pressure on the entire face of the envelope 9, and thus the press-fit unit 110 can be formed small.

Operation of Main Components of Enclosing and Sealing Machine

A description is given of an operation of the main components of the enclosing and sealing machine 30 configured in the above manner. As shown in FIG. 5, with the envelope lower paper 4 being the tip end in the transfer direction of the printed envelope sheet 1 placed at the front, the envelope sheet 1 is transferred into the gap between the main folding roller 42 and the sheet conveyer roller 43 along the envelope feed path FIR. The tip end of the envelope sheet 1 hits the first sheet end plate 44 while following a trajectory L1, and enters a bent portion 44*a* provided at an end of the first sheet end plate 44. Since the envelope sheet 1 is then further transferred by the main folding roller 42 and the sheet conveyer roller 43, the envelope sheet 1 follows a trajectory L2 so as to be in line with the inside of the first sheet end plate 44 with its tip end still hitting the bent portion 44*a* of the first sheet end plate 44. As the envelope sheet 1 is further transferred, a bulge L3 is formed in the envelope sheet 1, the bulge portion is sucked into the gap between the main folding roller 42 and the first auxiliary folding roller 45, and a "crease 1" is formed as the envelope sheet 1 passes between the main folding roller 42 and the first auxiliary folding roller 45.

Meanwhile, the printed content 7 held by the content standby unit 60 is passed along the content feed path NIR by the first and second pairs of content conveyer rollers 62, 63, and is enclosed in the "crease 1" formed by the main folding roller 42 and the first auxiliary folding roller 45.

Then, at the point where the printed content 7 is enclosed in the "crease 1," the envelope sheet 1 is folded up such that the front face of the envelope lower paper 4 of the envelope sheet 1 faces the water application pad 76 of the water application unit 70.

Then, with the folded envelope lower paper 4 at the front, the envelope sheet 1 is transferred by the main folding roller 42 and the first auxiliary folding roller 45 along a folding path FTR while following a trajectory L4. When passage of a predetermined time is detected by the controller 130 after the tip end of the folded envelope lower paper 4 is sensed by the sheet sensor 46, the tip end of the envelope lower paper 4 hits the second sheet end plate 103 provided in the water application unit 70.

At this time, the water application unit 70 is activated via the controller 130 and the storage unit 140, and the water 75 is automatically applied by the water application pad 76 to the remoistenable glue portion 8 previously attached to the predetermined adhesion position on the front face of the envelope lower paper 4 folded up in the envelope shape, of the envelope sheet 1 being transferred.

Furthermore, the folded envelope sheet 1 follows a trajectory L5 so as to be in line with a lower face of the upper side sheet transfer guide plate 93 with the tip end of the folded envelope lower paper 4 still hitting the second sheet end plate 103. As the envelope sheet 1 is further transferred, a bulge L6 is formed in the envelope sheet 1, the bulge portion is sucked into the gap between the main folding roller 42 and the second auxiliary folding roller 47, and a "crease 2" is formed as the envelope sheet 1 passes between the main folding roller 42 and the second auxiliary folding roller 47. Thus, the envelope sheet 1 is folded up such that the rear face of the envelope upper paper 2 faces the front face of the envelope lower paper 4 to be folded up in the envelope shape, and the envelope 9 is formed.

Then, the envelope sheet 1 with the "crease 2" formed therein is transferred by the main folding roller 42 and the second auxiliary folding roller 47, folded up into the envelope shape and sealed as the envelope 9. Subsequently, the envelope 9 is transferred to the press-fit portion 110 to press-fit the portions of the pressure-sensitive adhesive 6 provided on the left and right sides of the envelope 9. With this press-fit operation, the rear face of the envelope upper paper 2 of the envelope sheet 1 is surely adhered to the front face of the envelope lower paper 4, so that the envelope 9 is automatically sealed.

Afterwards, the envelope 9 created by the water application unit 70 and the press-fit unit 110 is discharged to the sheet discharger 120.

Water Application Unit of Embodiment of Invention

Hereinbelow, a detailed description will be given of the configuration of the water application unit 70 of the embodiment of the invention with reference to FIGS. 6 to 13.

Figure 6:
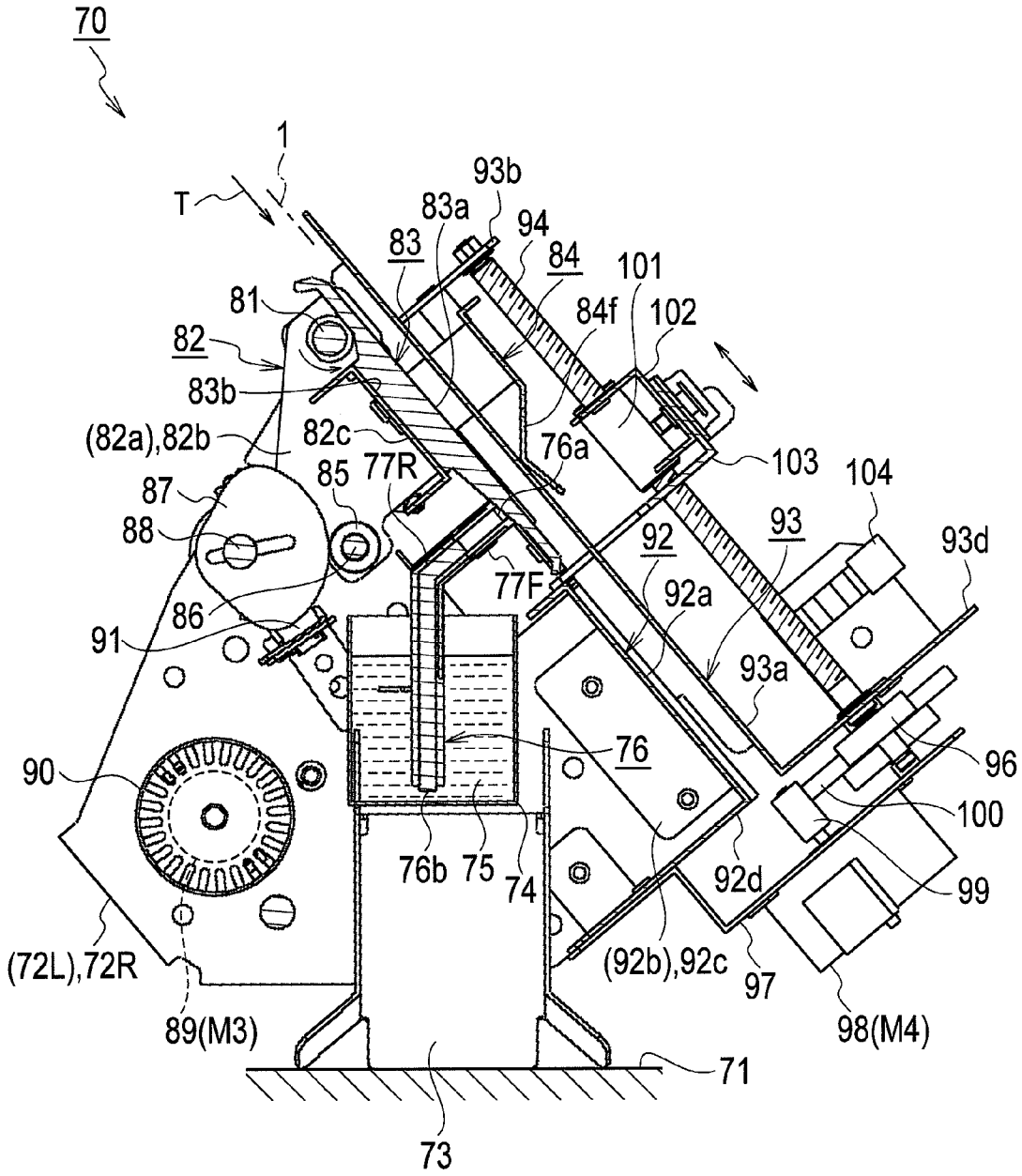
FIG. 6 is an enlarged side view of the water application unit of the embodiment of the invention, showing a state where turnable moving guide plates are in a sheet-receiving position.
Figure 7:
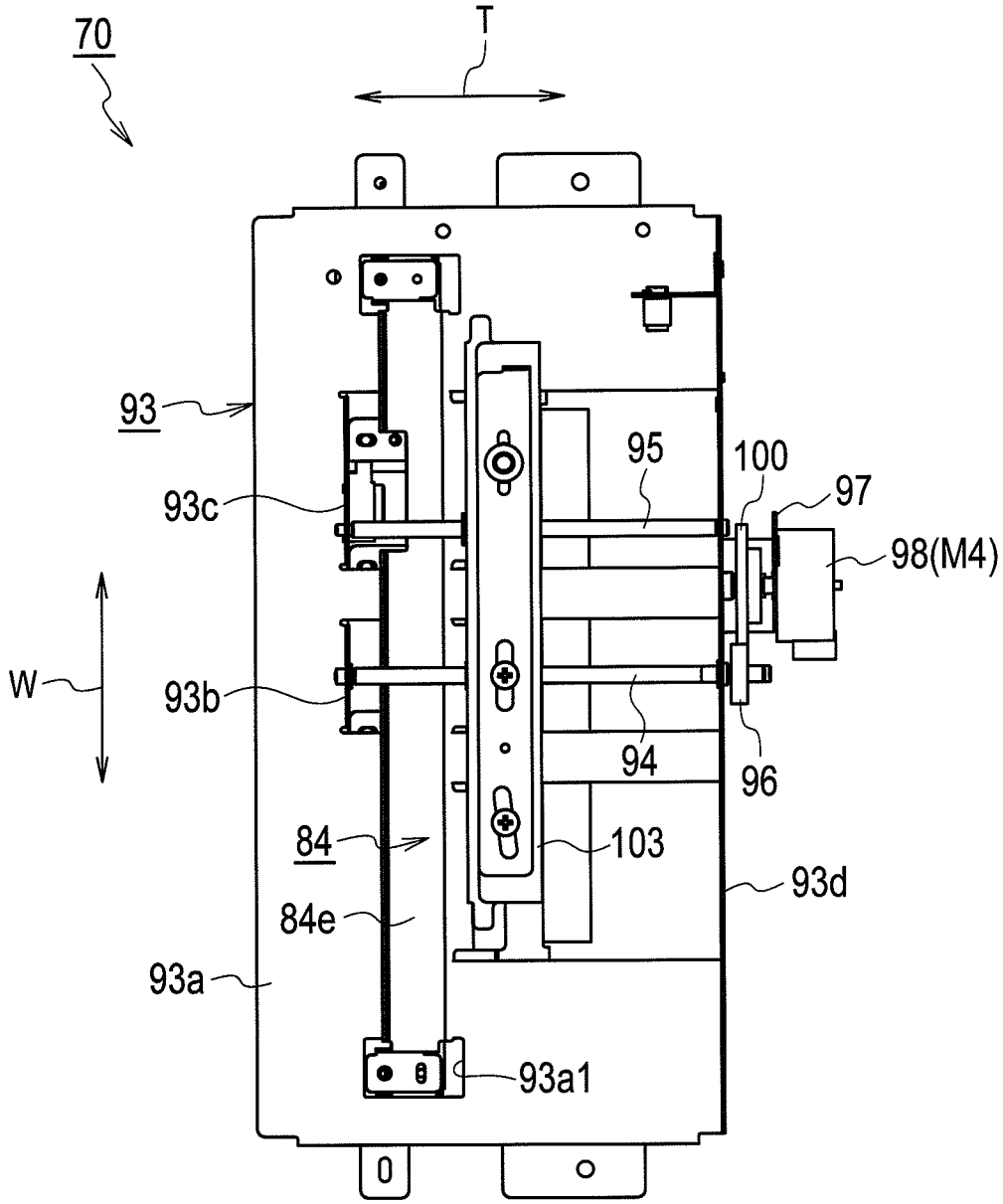
FIG. 7 is a top view of the water application unit of the embodiment of the invention.
Figure 8:
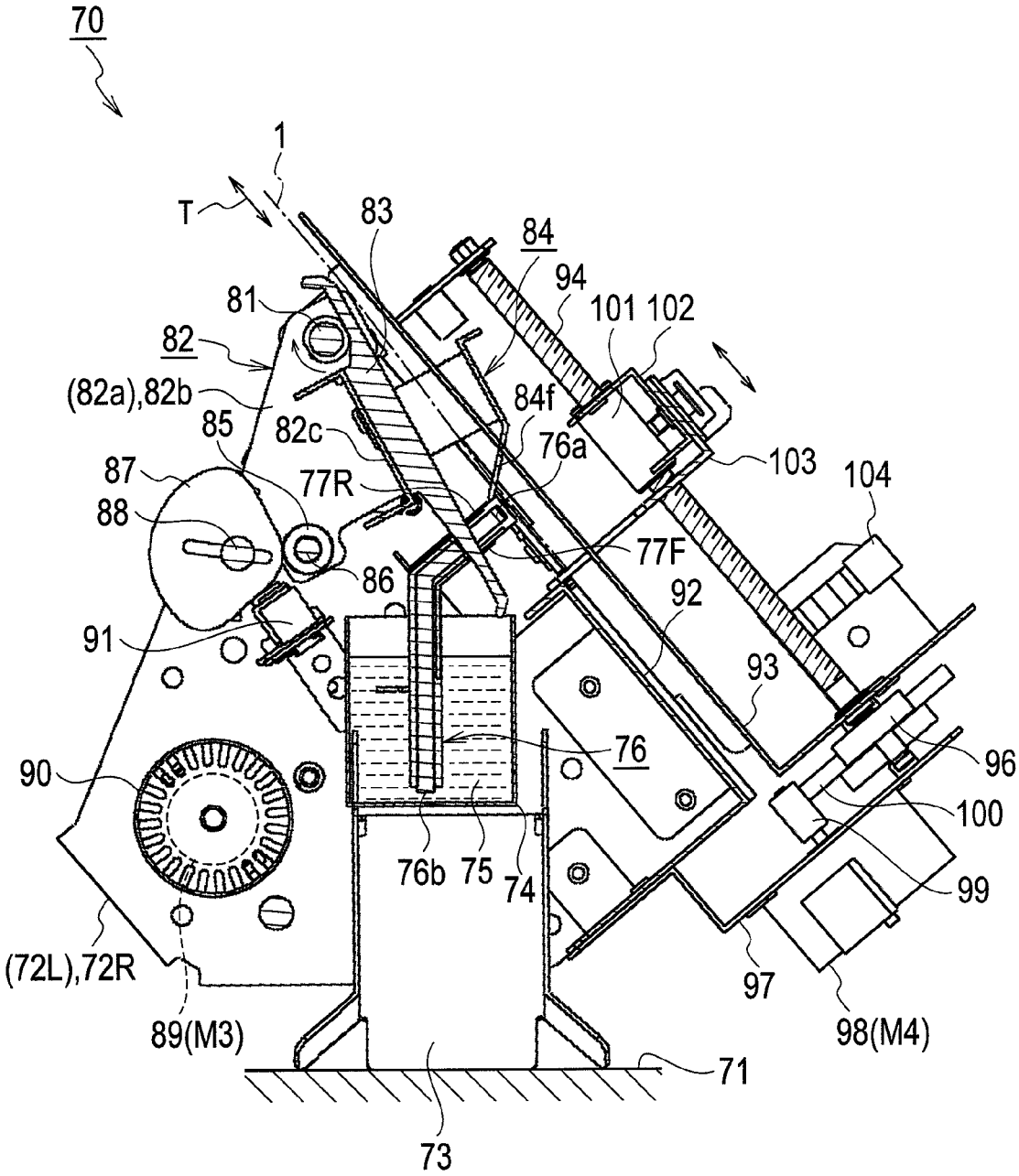
FIG. 8 is a side view of a state where the turnable moving guide plates are in a water application position in the water application unit of the embodiment of the invention.
Figure 9:
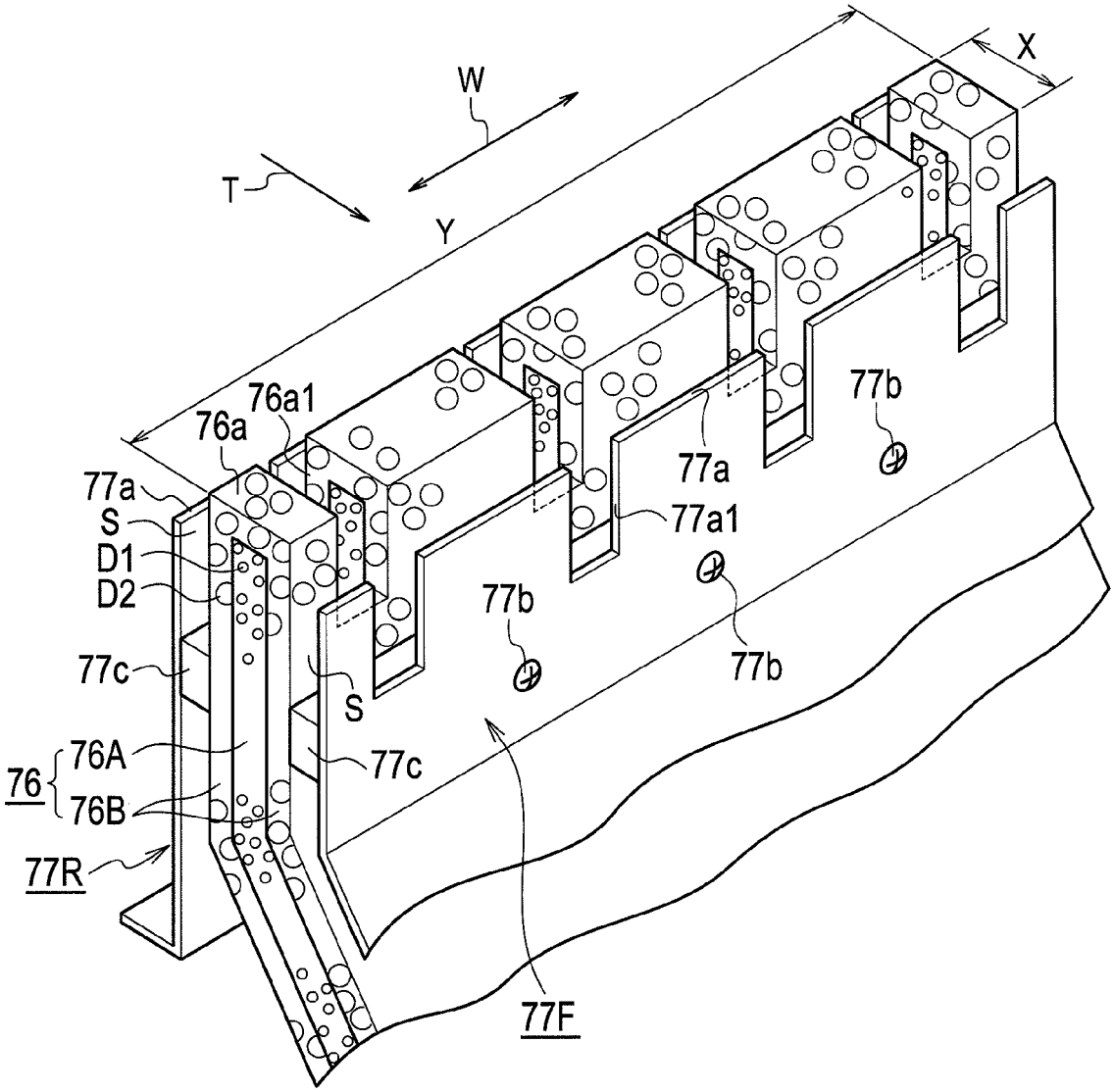
FIG. 9 is an enlarged perspective view of a water application pad and front and rear pad fixation plates provided in the water application unit of the embodiment of the invention.
Figure 12:
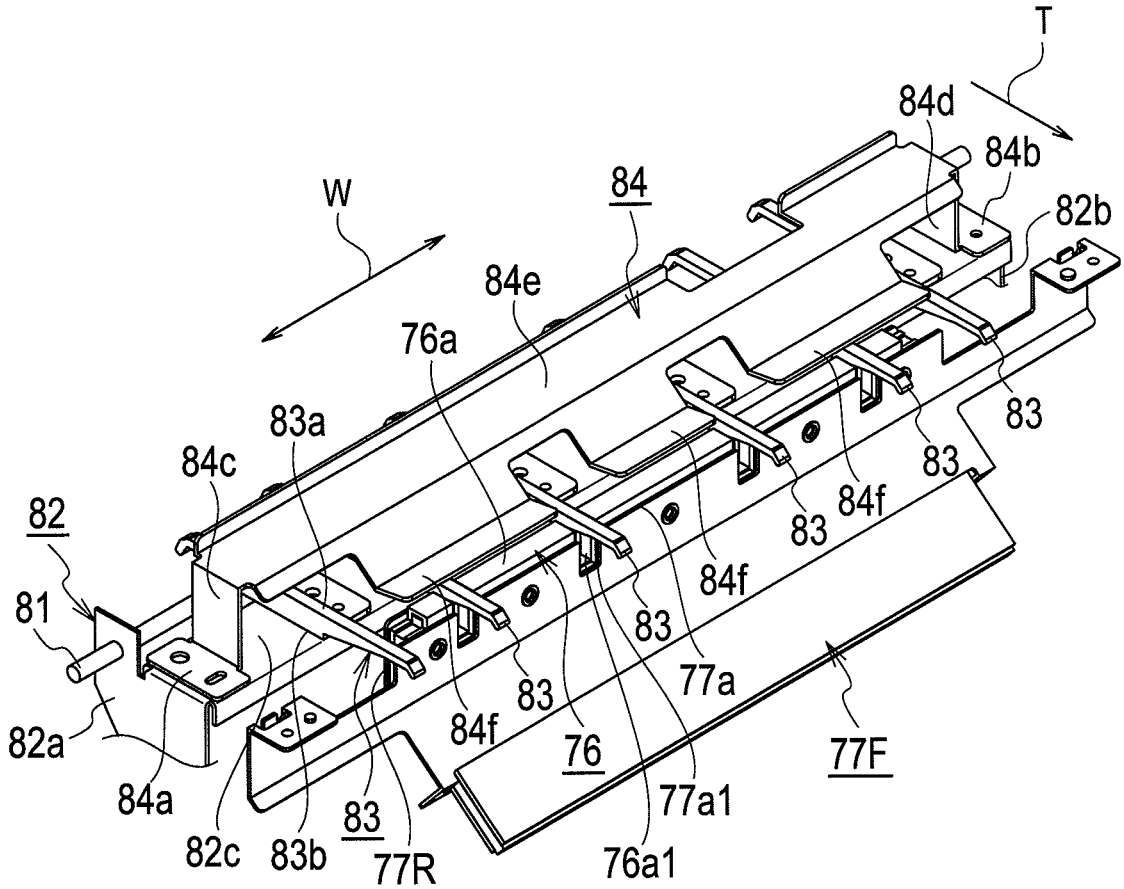
FIG. 12 is a perspective view showing an assembled state of a part near the water application pad in the water application unit of the embodiment of the invention.
Figure 13A:
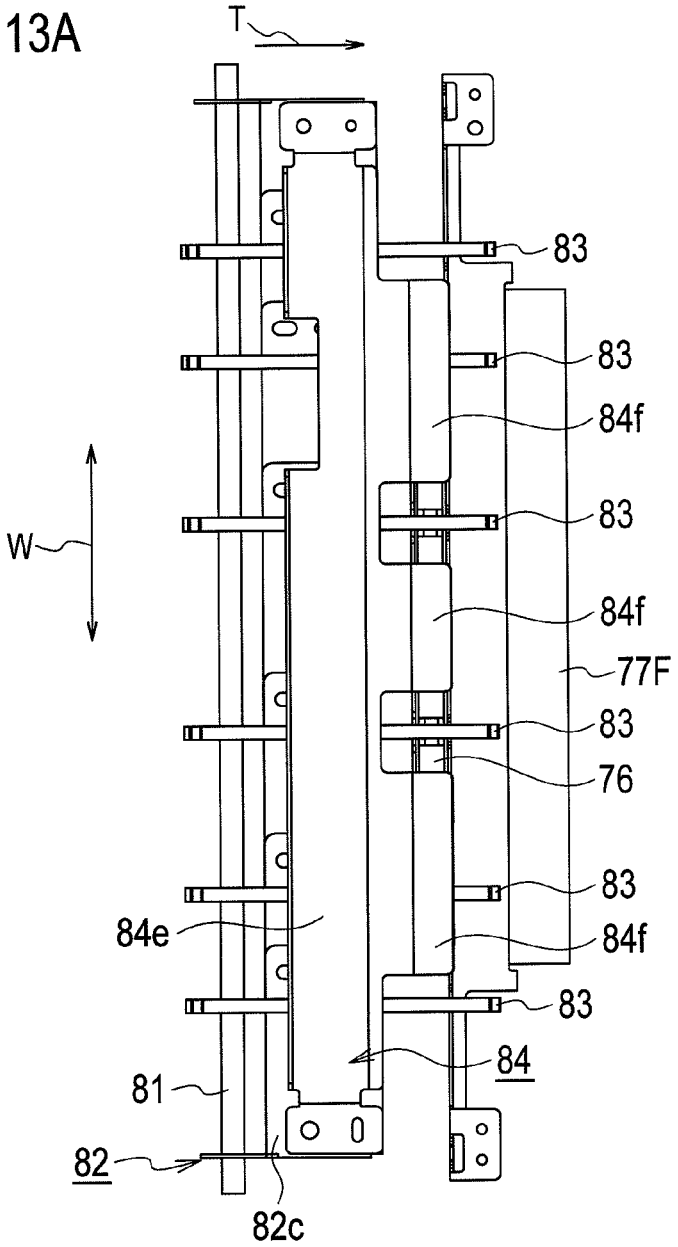
FIGS. 13A and 13B are top and side views showing the assembled state of the part near the water application pad in the water application unit of the embodiment of the invention.
Figure 13B:
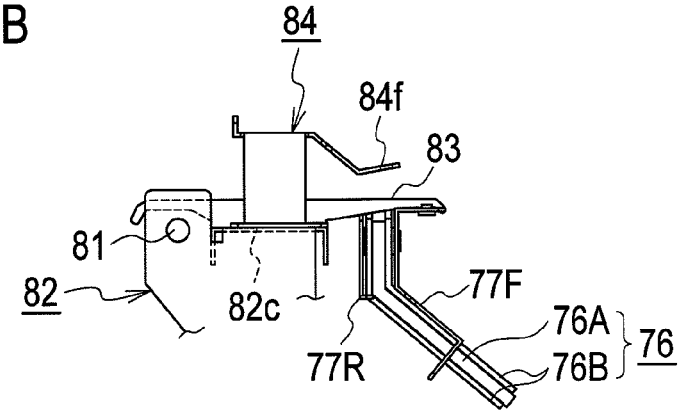

FIGS. 6 to 8 are enlarged views showing the water application unit 70 of the embodiment of the invention. FIGS. 9 to 11 show the water application pad which is included in a main part of the water application unit 70 of the embodiment of the invention. FIGS. 12 and 13 show an assembled state of a part near the water application pad in the water application unit 70 of the embodiment of the invention. FIG. 6 shows a state where the turnable moving guide plates 83 are in a sheet-receiving position, and FIG. 8 shows a state where the turnable moving guide plates 83 are in a water application position.

As shown in the enlarged view of FIG. 6, the water application unit 70 of the embodiment of the invention is installed between a bottom plate 71, and a left and right pair of side plates (72L), 72R provided perpendicular to the bottom plate 71 on the left and right of the sheet width direction perpendicular to the transfer direction of the envelope sheet 1, the two side plates facing each other with a space larger than the width of the envelope sheet 1 interposed therebetween.

In the water application unit 70, a container holding member 73 is fixedly disposed vertically on the bottom plate 71, and the reservoir 74 is detachably placed on an upper part of the container holding member 73. The water 75 is pooled in the reservoir 74.

The water application pad 76 is bent in a "V" shape. The water application pad 76 includes a portion (hereinafter referred to as an upper end 76*a* portion) toward an upper end portion (an upper end) 76*a* being the water applying portion of the water application pad 76 and a portion (hereinafter referred to as a lower end 76*b* portion) toward a lower end portion (a lower end) 76*b* located opposite to the upper end 76*a* portion and immersed in the water 75 pooled in the reservoir 74.

Additionally, the upper end 76*a* portion of the water application pad 76 (i.e. a portion of the water application pad 76 toward the upper end 76*a*) is exposed to the outside and extends obliquely upward to the right, while being sandwiched and held between front and rear pad-sandwiching plates 77F, 77R attached to front and rear sides of the water application pad 76 in the sheet transfer direction.

The water 75 in the reservoir 74 is sucked up from the lower end 76*b* of the water application pad 76 toward the upper end 76*a* thereof by capillary action.

The water application pad 76 is bent in the "V" shape toward the upper end 76*a* portion due to arrangement of the sheet transfer path inside the water application unit 70. Hence, if the sheet transfer path is arranged differently, the upper end 76*a* and lower end 76*b* of the water application pad 76 may be formed straight without being bent toward each other.

The water application pad 76 has a function of automatically applying water to the remoistenable glue portion 8, previously attached to the predetermined adhesion position on the front face of the envelope lower paper 4 of the envelope sheet 1.

Here, a specific description is given of the water application pad with reference to FIG. 9.

As shown in the enlarged view of FIG. 9, the water application pad 76 is formed of a sponge made of polyurethane resin or the like having a continuous porous structure, and is formed integrally by allowing a first pad member 76A contact a second pad member 76B. Note that the lower end 76*b* portion is omitted in FIG. 9.

The first pad member 76A includes pores (first pores) having a small pore diameter D1. In a case of using a sponge of a pore diameter D1 of approximately 20 μm to 60 μm, for example, although only a small amount of the water 75 (FIGS. 5, 6 and 8) is sucked up, the water 75 is efficiently sucked up by capillary action.

On the other hand, the second pad member 76B includes pores (second pores) having a pore diameter D2 larger than the pore diameter D1 of the first pad member 76A. In a case of using a sponge of a pore diameter D2 of approximately 40 μm to 100 μm, for example, although the sucking up by capillary action is made less efficient because of gravity, a large amount of the water 75 is sucked up.

As shown in the drawing, the water application pad 76 of the embodiment is formed by: using the first pad member 76A as the core, covering an upper end portion (upper end) of the first pad member 76A and front and rear sides thereof in the sheet transfer direction with the second pad member 76B; thereby sandwiching both sides of the first pad member 76A in the sheet transfer direction with the second pad member 76B. Since the first and second pad members 76A and 76B are thus allowed to contact each other, the water 75 (FIGS. 5, 6 and 8) can be applied to the remoistenable glue portion 8 by the upper end 76*a* of the water application pad 76 covered with the second pad member 76B.

The outer dimension of the upper end 76*a* of the water application pad 76 is set in correspondence with the outer dimension of the remoistenable glue portion 8 described earlier with reference to FIG. 1, where a short width X mm is set in the sheet transfer direction, and a long length Y mm is set along the sheet width direction.

At this time, since the total of the thicknesses of the first and second pad members 76A, 76B in the sheet transfer direction is the width X mm, the individual thicknesses of the first and second pad members 76A, 76B are appropriately set according to the required water application amount, while maintaining the width X mm.

Additionally, on the upper end 76*a* portion of the water application pad 76, multiple cutouts 76*a*1 are formed at predetermined intervals in the sheet transfer direction, each of the cutouts 76*a*1 being narrowly cut out in a depressed shape. The later-mentioned multiple moving guide plates 83 (FIGS. 5, 6, 8, 12 and 13) are allowed to move in and out of these multiple cutouts 76*a*1.

Note that although the remoistenable glue portion 8 described earlier with reference to FIG. 1 has a long length Y mm along the sheet width direction, the configuration is not limited to this. Alternatively, the remoistenable glue portion 8 may be divided into multiple parts along the sheet width direction, to avoid the multiple cutouts 76*a*1 formed on the upper end 76*a* portion of the water application pad 76.

Any of multiple structural forms shown in FIGS. 10A to 10D can be applied to the water application pad 76. Note that the lower end 76*b* portion is omitted in FIGS. 10A to 10D.

Figure 10A:
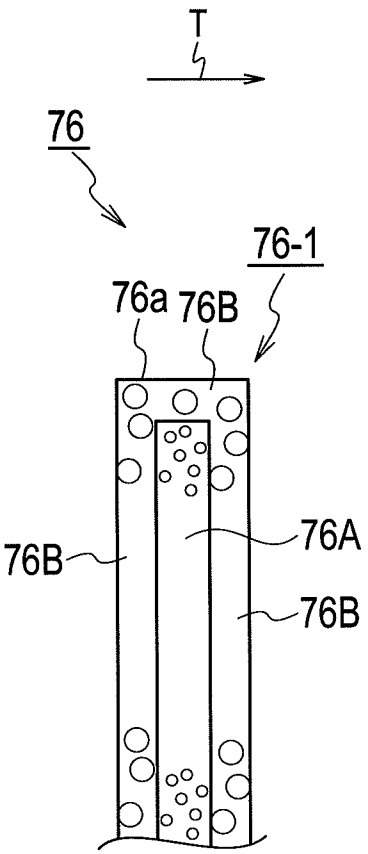
FIGS. 10A to 10D are views schematically showing first to fourth structural forms of the water application pad.

Specifically, a water application pad 76-1 according to a first structural form of FIG. 10A is the same structural form as the aforementioned embodiment, where the first pad member 76A is used as the core, and the upper end portion (upper end) of the first pad member 76A and the front and rear sides thereof in the sheet transfer direction are covered with the second pad member 76B to join the first and second pad members 76A, 76B with each other.

Figure 10B:
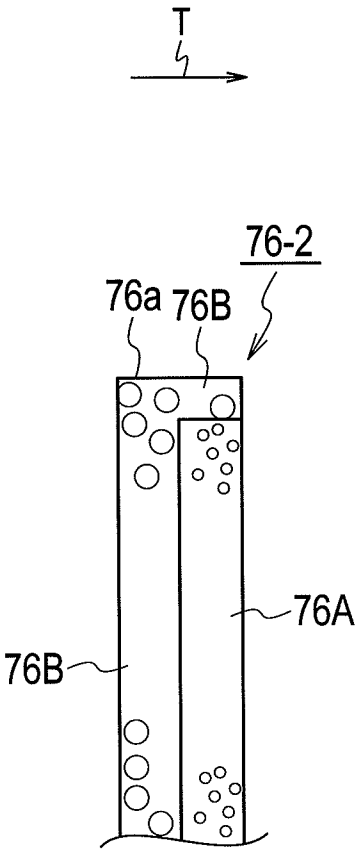
Figure 10C:
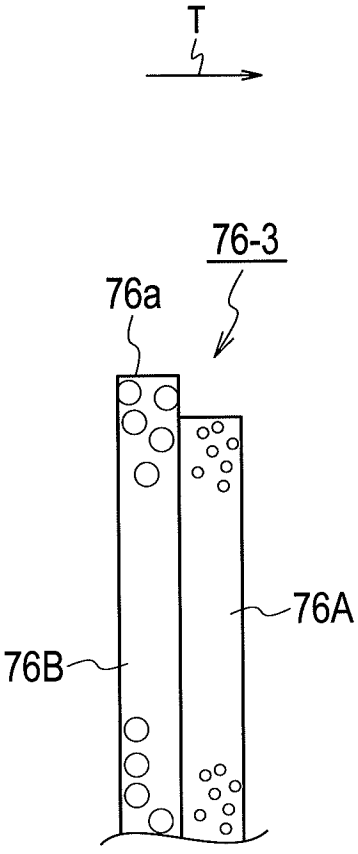

In a water application pad 76-2 according to a second structural form of FIG. 10B, the upper end of the first pad member 76A and one side thereof in the sheet transfer direction is covered with the second pad member 76B to join the first and second pad members 76A, 76B with each other.

In a water application pad 76-3 according to a third structural form of FIG. 100, the upper end of the first pad member 76A is formed slightly lower than the upper end of the second pad member 76B so that a step is formed between the two, to join the first and second pad members 76A, 76B with each other.

Figure 10D:
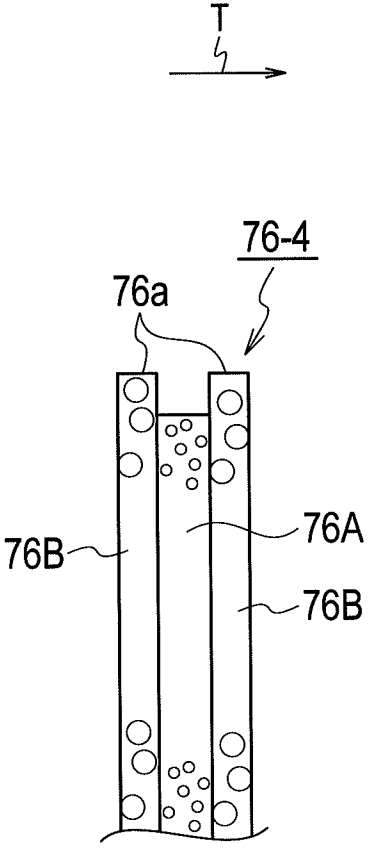

In a water application pad 76-4 according to a fourth structural form of FIG. 10D, front and rear sides of the first pad member 76A in the sheet transfer direction are covered with the second pad member 76B to sandwich both sides of the first pad member 76A in the transfer direction with the second pad member 76B. Additionally, the upper end of the first pad member 76A is formed slightly lower than the upper ends of the second pad members 76B so that steps are formed among the pad members. Thus, the first and second pad members 76A, 76B are joined with each other.

In any of the first to fourth structural forms, the water application pad 76 (76-1 to 76-4) is configured in the following manner. Specifically, the water application pad 76: includes the first pad member 76A and the second pad member 76B allowed to contact each other, the first pad member 76A at least installed at a position where it is immersed in the reservoir 74 (FIGS. 5, 6 and 8) and including the pores having the pore diameter D1 for sucking up the water 75 (FIGS. 5, 6 and 8) in the reservoir 74, and the second pad member 76B at least installed at a position facing the remoistenable glue portion 8 and including the pores having the pore diameter D2 formed larger than the pore diameter D1 of the pores of the first pad member 76A to apply the water 75 to the remoistenable glue portion 8; and the upper end 76*a* of the water application pad 76 covered with the second pad member 76B serves as the applying surface.

Here, although the other end (lower end) of the second pad member 76B is immersed in the reservoir 74, the second pad member 76B does not suck up the water 75 efficiently, and thus to support the sucking up of the water 75, the first pad member 76A capable of efficiently sucking up the water 75 is allowed to contact the second pad member 76B.

With this configuration, when the lower end 76*b* portion of the water application pad 76 (76-1 to 76-4) is immersed in the reservoir 74 (FIGS. 5, 6 and 8), the first pad member 76A including the pores having the small pore diameter D1 surely sucks up the water 75 (FIGS. 5, 6 and 8) in the reservoir 74 by capillary action, and the second pad member 76B including the pores having the large pore diameter D2 receives the water 75 sucked up by the first pad member 76A and applies the water 75 onto the remoistenable glue portion 8. Accordingly, it is possible to automatically apply an appropriate amount of the water 75 to the remoistenable glue portion 8 by the upper end 76*a* of the water application pad 76 covered with the second pad member 76B.

Hence, considering the problem described in the related art, the water application pad 76 (76-1 to 76-4) in which the first and second pad members 76A, 76B are allowed to contact each other can satisfy both the first function of surely sucking up the water 75 from the reservoir 74, and the second function of applying an appropriate amount of the water 75 to the remoistenable glue portion 8. In this manner, the water application pad 76 can surely apply an appropriate amount of the water 75 to the remoistenable glue portion 8.

Although two types of sponges having different pore diameters are used as the material of the water application pad 76 in this embodiment, the invention is not limited to this, and any two types of moisturizing material having different pore diameters and capable of satisfying both the above two functions may be used.

Moreover, in the water application pad 76 (76-1 to 76-4), only the upper end 76*a* of the water application pad 76 covered with the second pad member 76B including the pores having the large pore diameter D2 is in contact with the remoistenable glue portion 8, while the upper end of the first pad member 76A including the pores having the small pore diameter D1 is not in contact with the remoistenable glue portion 8. For this reason, no phenomenon occurs in which the water 75 applied to the remoistenable glue portion 8 is returned to the upper end 76*a* of the water application pad 76 at the point when the upper end 76*a* of the water application pad 76 separates from the remoistenable glue portion 8. Hence, the amount of the water 75 applied to the remoistenable glue portion 8 is not reduced.

Referring back to FIG. 9, the front and rear pad-sandwiching plates 77F, 77R are respectively attached to a front face of the water application pad 76 located in the upstream in the transfer direction of the envelope sheet 1 and to a rear face of the water application pad 76 located in the downstream in the transfer direction of the envelope sheet 1, at the upper end 76*a* portion of the water application pad 76 being the portion to apply the water 75 to the remoistenable glue portion 8. The front and rear pad-sandwiching plates 77F, 77R are for sandwiching and holding the first and second pad members 76A, 76B forming the water application pad 76.

Upper ends 77*a*, 77*a* of the front and rear pad-sandwiching plates 77F, 77R are formed lower than the upper end 76*a* of the water application pad 76 so that the upper end 76*a* of the water application pad 76 can be exposed. Moreover, the front and rear pad-sandwiching plates 77F, 77R are fastened by multiple screw portions 77*b* in a manner as to sandwich the front and rear sides of the water application pad 76, while left and right ends of the front and rear pad-sandwiching plates 77F, 77R in the sheet transfer direction are fixedly supported by the left and right pair of side plates (72L), 72R.

By sandwiching and holding the upper end 76*a* portion of the water application pad 76 with the front and rear pad-sandwiching plates 77F, 77R, it is possible to provide rigidity in the upper end 76*a* portion of the water application pad 76 formed of the flexible sponge. This configuration can prevent misalignment of the upper end 76*a* of the water application pad 76 on the remoistenable glue portion 8.

Additionally, the upper end 77*a*, 77*a* portions of the front and rear pad-sandwiching plates 77F, 77R also have multiple cutouts 77*a*1 formed therein to allow the later-mentioned multiple moving guide plates 83 (FIGS. 5, 6, 8, 12 and 13) to move in and out, the multiple cutouts 77*a*1 formed in correspondence with the multiple cutouts 76*a*1 formed on the upper end 76*a* portion of the water application pad 76 and narrowly cut out in a depressed shape.

Figure 11A:
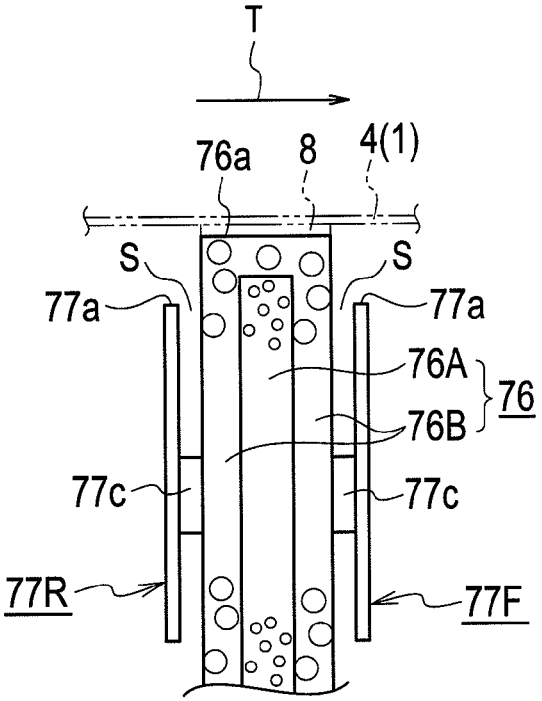
FIGS. 11A and 11B are schematic views for describing shapes of front and rear pad-sandwiching plates supporting front and rear sides of the water application pad.

As shown in FIG. 11A, spacers 77*c*, 77*c* having a predetermined thickness are provided along the sheet width direction between upper portions of the front and rear sides of the water application pad 76 in the transfer direction and upper portions of the front and rear pad-sandwiching plates 77F, 77R, on the upper end 76*a* (one end) portion of the water application pad 76 for applying the water 75 onto the remoistenable glue portion 8. The spacers 77*c*, 77*c* form spaces S, S on the upper end 76*a* portion of the water application pad 76.

Note that instead of the spacers 77*c*, 77*c* having the predetermined thickness, multiple boss portions (not shown) may be provided between the front and rear pad-sandwiching plates 77F, 77R along the sheet width direction at a predetermined interval. The multiple boss portions may be provided between the front and rear pad-sandwiching plates 77F, 77R by penetrating the water application pad 76, to thereby form the spaces S, Son the upper end 76*a* portion of the water application pad 76.

When the water 75 (FIGS. 5, 6 and 8) is applied to the remoistenable glue portion 8 by the upper end 76*a* of the water application pad 76, the upper end 76*a* of the water application pad 76 is pressed by a later-mentioned sheet pressing member 84 via the remoistenable glue portion 8, and some of the water 75 is splashed from the remoistenable glue portion 8. However, the splashed water 75 falls into the spaces S, S without wetting the envelope sheet 1 surrounding the remoistenable glue portion 8 or the sheet transfer path in the water application unit 70, and thus does not affect the transfer of the envelope sheet 1.

Moreover, the extra water 75 splashed from the remoistenable glue portion 8 can be returned to the reservoir 74 via the spaces S, S.

Figure 11B:
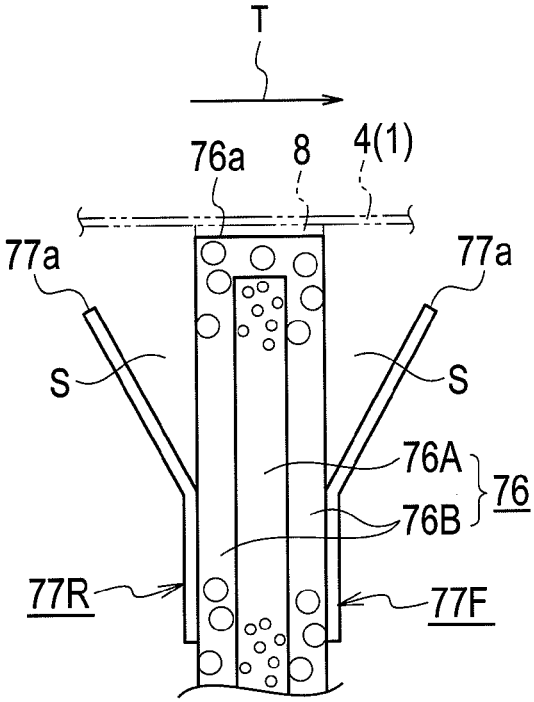

When forming the spaces S, S between the upper portions of the front and rear sides of the water application pad 76 in the transfer direction and the upper portions of the front and rear pad-sandwiching plates 77F, 77R, the spacers 77*c*, 77*c* having the predetermined thickness are attached to the upper portions (the upper portion 77*a*, 77*a* portions) of the front and rear pad-sandwiching plates 77F, 77R in the embodiment shown in FIG. 11A. However, the spaces S, S may alternatively be formed by bending the upper portions (the upper end 77*a*, 77*a* portions) of the front and rear pad-sandwiching plates 77F, 77R in a manner as to spread obliquely upward toward the outside, as shown in FIG. 11B.

Referring back to FIG. 6, in an upper portion of the left and right pair of side plates (72L), 72R on the upstream side of the transfer direction of the envelope sheet 1, a long shaft 81 is laid across the left and right pair of side plates (72L), 72R along the width direction of the envelope sheet 1.

Moreover, a moving bracket 82 formed by being bent by a sheet metal processing equipment is supported to be turnable in upper and lower directions on the shaft 81.

In the moving bracket 82, a pair of side plates (82*a*), 82*b* is formed in a downward extending shape inside the left and right pair of side plates (72L), 72R on the left and right of the sheet width direction so as to face each other with a space slightly larger than the width of the envelope sheet 1 in between. The shaft 81 is attached to the upper left portions of the pair of side plates (82*a*), 82*b*.

In an upper portion of the moving bracket 82, a fixing portion 82*c* for fixing the multiple moving guide plates 83 and the sheet pressing member 84 is integrally laid across the pair of side plates (82*a*), 82*b*.

As shown in FIGS. 12 and 13, the multiple moving guide plates 83 fixed to the fixing portion 82*c* of the moving bracket 82 have a function of guiding the lower side of the envelope sheet 1.

Each of the multiple moving guide plates 83 includes a top face 83*a* made of resin material for guiding the lower side of the envelope sheet 1, and a bottom face 83*b* fixed to the fixing portion 82*c* of the moving bracket 82, both faces being formed flat. In addition, the moving guide plate 83 is formed to have a long length in the sheet transfer direction, and a narrow width in the sheet width direction.

The multiple moving guide plates 83 are fixed to the fixing portion 82*c* of the moving bracket 82 at a predetermined interval. Moreover, the multiple moving guide plates 83 face the multiple cutouts 76*a*1 formed by cutting out the upper end 76*a* of the water application pad 76, and the multiple cutouts 77*a*1 formed by cutting out the upper portions 77*a*, 77*a* of the front and rear pad-sandwiching plates 77F, 77R, so as to be capable of moving in and out of the respective cutouts.

The sheet pressing member 84 fixed to the fixing portion 82*c* of the moving bracket 82 has a function of pressing the remoistenable glue portion 8 previously attached to the envelope lower paper 4 of the envelope sheet 1 when the water is applied.

The sheet pressing member 84 is formed by being bent by a sheet metal processing equipment. In the sheet pressing member 84, a pair of raised parts 84*c*, 84*d* is raised upward with a space in between from left and right attachments 84*a*, 84*b* fixed to the fixing portion 82*c* of the moving bracket 82. Upper ends of the pair of raised parts 84*c*, 84*d* are connected by a connection part 84*e* along the sheet width direction, and multiple sheet pressing parts 84*f* extend from the connection part 84*e*, each sheet pressing part 84*f* forming a "V" shape toward the downstream of the sheet transfer direction.

The connection part 84*e* of the sheet pressing member 84 faces a relief hole 93*a*1 (shown only in FIG. 7) formed in a lower plate 93*a* of the upper side sheet transfer guide plate 93 along the sheet width direction, the upper side sheet transfer guide plate 93 being provided above the moving bracket 82 to face the moving bracket 82.

When a part near the water application pad 76 is assembled, the water application pad 76 is installed on the rear face side of the multiple moving guide plates 83 so as to be perpendicular thereto, along the sheet width direction. In addition, the multiple sheet pressing parts 84*f* formed in the sheet pressing member 84 are installed above the upper end 76*a* of the water application pad 76, so as to be parallel to the upper end 76*a* of the water application pad 76.

Referring back to FIG. 6, in the downstream of the moving guide plates 83 fixed to the moving bracket 82, the lower side sheet transfer guide plate 92 for guiding the lower side of the envelope sheet 1 is provided in parallel to the moving guide plates 83 along the sheet transfer direction, with a slight space in between.

The lower side sheet transfer guide plate 92 is formed by being bent by a sheet metal processing equipment. In the lower side sheet transfer guide plate 92, an upper plate 92*a* for guiding the lower side of the envelope sheet 1 is formed flat, and a pair of side plates (92*b*), 92*c* is formed by being bent downward from left and right ends of the upper plate 92*a* in the sheet width direction so as to face each other, and attached to the inner sides of the left and right pair of side plates (72L), 72R. Additionally, a side plate 92*d* is formed by being bent downward from the downstream end of the upper plate 92*a* in the sheet transfer direction.

The upper side sheet transfer guide plate 93 for guiding the upper side of the envelope sheet 1 with a long length is fixedly installed along the sheet transfer direction, so as to face the moving guide plates 83 and the lower side sheet transfer guide plate 92 with a predetermined space in between.

The upper side sheet transfer guide plate 93 is also formed by being bent by sheet metal processing equipment. In the upper side sheet transfer guide plate 93, the lower plate 93*a* for guiding the upper side of the envelope sheet 1 is formed flat, and a first cut-and-raised part 93*b* and a second cut-and-raised part 93*c* (shown only in FIG. 7) are cut and raised upward on the upstream side of the lower plate 93*a* in the sheet transfer direction. Additionally, a side plate 93*d* is formed by being bent upward from the downstream end of the lower plate 93*a* in the sheet transfer direction.

A cam follower 85 is rotatably supported by a shaft 86 in a lower portion on the inner side of the right side plate 82*b* of the pair of side plates (82*a*), 82*b* of the moving bracket 82.

In addition, a fan-shaped cam 87 abutting the cam follower 85 is rotatably supported by a shaft 88 on the inner side of the right side plate 72R of the left and right pair of side plates (72L), 72R.

The fan-shaped cam 87 can be rotated by being transmitted the rotation of the third motor 89 attached to a lower portion of the right side plate 72R, via a transmission structure such as an unillustrated gear or a timing belt. At this time, the third motor 89 may either be rotated in one direction, or be rotated in forward and reverse directions for 180 degrees.

Note that reference numeral 90 indicates an FG plate attached to a rear end shaft of the third motor 89.

Moreover, an unillustrated shield plate is fixed to the shaft 88 of the fan-shaped cam 87 rotated by the third motor 89, and a home-position sensor 91 is installed to face the shield plate. This home-position sensor 91 senses the standby position of the fan-shaped cam 87.

When the water application unit 70 is in a standby state, as shown in FIG. 6, the standby position of the fan-shaped cam 87 is sensed by the home-position sensor 91, and thus the third motor 89 suspends its rotation.

At this time, the moving bracket 82 and the moving guide plates 83 are integrally turned in the counterclockwise direction about the shaft 81 in advance. Accordingly, the moving guide plates 83 are substantially parallel to the upper side sheet transfer guide plate 93 with a space in between, and the moving guide plates 83 are in a sheet-receiving position.

When the moving guide plates 83 are in the sheet-receiving position, the sheet pressing member 84 is also turned in the counterclockwise direction about the shaft 81 in advance integrally with the moving bracket 82. Hence, the sheet pressing parts 84*f* of the sheet pressing member 84 are separated from the upper edge 76*a* of the water application pad 76, and are retracted to the side of the lower plate 93*a* of the upper side sheet transfer guide plate 93.

On the other hand, as shown in FIG. 8, at the time of water application where the third motor 89 is activated to rotate the fan-shaped cam 87 a half-turn from the standby position to apply the water 75, the moving guide plates 83 are turned in the clockwise direction about the shaft 81 integrally with the moving bracket 82, via the cam follower 85 following the fan-shaped outer circumference of the cam 87. With this, the moving guide plates 83 become inclined obliquely downward to the right, and are in a water application position.

When the moving guide plates 83 are in the water application position, the sheet pressing member 84 is also turned in the clockwise direction about the shaft 81 integrally with the moving bracket 82. Hence, the sheet pressing parts 84*f* of the sheet pressing member 84 are capable of pressing the remoistenable glue portion 8.

Next, as shown in FIG. 6, a lead screw 94 is pivotally supported between the side plate 93*d* and the first cut-and raised part 93*b* formed in the substantial center of the upper side sheet transfer guide plate 93 in the sheet width direction. Additionally, a guide shaft 95 (only shown in FIG. 7) is fixedly supported between the side plate 93*d* and the second cut-and raised part 93*c* (only shown in FIG. 7) formed backward of the first cut-and raised part 93*b*.

A front (downstream side) end of the lead screw 94 extends to the outside of the side plate 93*d* of the upper side sheet transfer guide plate 93, and a gear 96 is fixed to the extended portion.

A motor bracket 97 is fixed to the side plate 92*d* of the lower side sheet transfer guide plate 92, the fourth motor 98 is attached to the motor bracket 97, and a gear 99 is attached to the front end shaft of the fourth motor 98.

The gear 99 fixed to the shaft of the fourth motor 98 meshes with the gear 96 fixed to the lead screw 94 via a reduction gear train 100.

A nut 101 is screwed with the lead screw 94, a bracket 102 is integrally fixed with the nut 101, and an unillustrated guide part formed in the bracket 102 engages with the guide shaft (only shown in FIG. 7). Accordingly, the bracket 102 integrally fixed with the nut 101 does not lean in front, rear, left or right directions, and can be moved along the lead screw 94 in the direction indicated by an arrow.

Furthermore, the second sheet end plate 103 for blocking a tip end of the envelope lower paper 4 of the envelope sheet 1 folded up in the envelope shape is fixed to the bracket 102. The second sheet end plate 103 is bent in an "L" shape and extends downward toward the flat upper plate 92*a* of the lower side sheet transfer guide plate 92.

Consequently, the second sheet end plate 103 can also be moved integrally with the bracket 102 along the lead screw 94 in the direction indicated by the arrow.

A position sensor 104 for sensing the moving state of the second sheet end plate 103 is installed near the front (downstream side) of the lead screw 94. The position sensor 104 senses that the second sheet end plate 103 is in the home position via the controller 130, measures the number of pulses of the fourth motor relative to the home position, and thereby controls the movement of the second sheet end plate 103.

At this time, the second sheet end plate 103 refers to form information on the position information of the remoistenable glue portion 8 stored in the storage unit 140 (FIG. 3) via the controller (FIG. 3). This allows the second sheet end plate 103 to move to a position where the tip end of the envelope lower paper 4 of the envelope sheet 1 folded up in the envelope shape in the transfer direction comes in contact with the second sheet end plate 103, and to stop in this position.

Operation of Water Application Unit of Embodiment of Invention

Hereinbelow, an operation of the water application unit 70 of the embodiment of the invention configured in the above manner will be described with reference to the aforementioned FIGS. 3, 5, 6, 8 and other drawings which are FIGS. 14A to 14D.

FIGS. 14A to 14D show an operation of the water application unit of the embodiment of the invention.

Figure 14A:
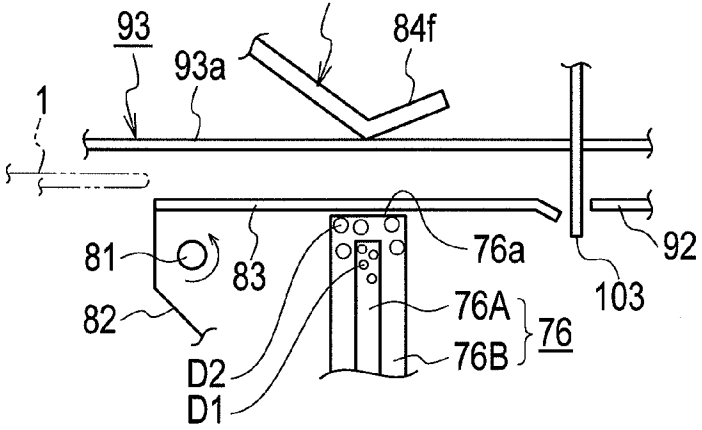
FIGS. 14A to 14D are schematic sequence diagrams for describing an operation of the water application unit of the embodiment of the invention.

Firstly, in the envelope sheet standby state of FIG. 14A, the moving guide plates 83 fixed to the moving bracket 82 and the sheet pressing member 84 turn upward about the shaft 81, and the moving guide plates 83 are kept substantially parallel to the upper side sheet transfer guide plate 93 with a space in between. Additionally, the sheet pressing parts 84*f* of the sheet pressing member 84 are separated from the upper end 76*a* of the water application pad 76, and are retracted to the side of the lower plate 93*a* of the upper side sheet transfer guide plate 93.

Then, the water application unit awaits the envelope sheet 1 to be transferred into the space between the moving guide plates 83 and the upper side sheet transfer guide plate 93.

The water application pad 76 is in a standby state below the moving guide plates 83, the water application pad 76 including the first pad member 76A including the pores having 5 the small pore diameter D1 and the second pad member 76B including the pores having the pore diameter D2 larger than the pore diameter D1, and the two pad members being allowed to contact each other.

The second sheet end plate 103 is moved to a position where the tip end of the envelope lower paper 4 of the envelope sheet 1 folded up in the envelope shape comes in contact with the second sheet end plate 103, and is stopped in this position.

Figure 14B:
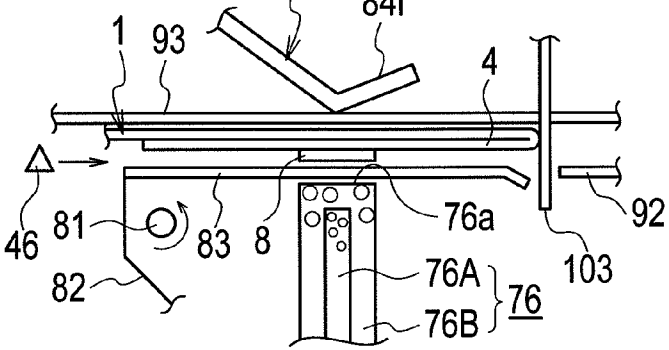

Next, in the envelope sheet receiving state of FIG. 14B, the moving guide plates 83 and the sheet pressing member 84 fixed to the moving guide plate 83 are firstly kept in the state of FIG. 14A. When the tip end of the envelope lower paper 4 of the envelope sheet 1 folded up in the envelope shape passes the sheet sensor 46, it is transferred into the gap between the moving guide plates 83 and the upper side transfer guide plate 93. A predetermined time passes after the sheet sensor 46 senses the tip end of the envelope lower paper 4 and the tip end of the envelope lower paper 4 hits the second sheet end plate 103.

At this time, the remoistenable glue portion 8 previously attached to the front face of the envelope lower paper 4 faces the upper end 76*a* of the water application pad 76, and thus the transfer of the envelope sheet 1 is suspended.

Figure 14C:
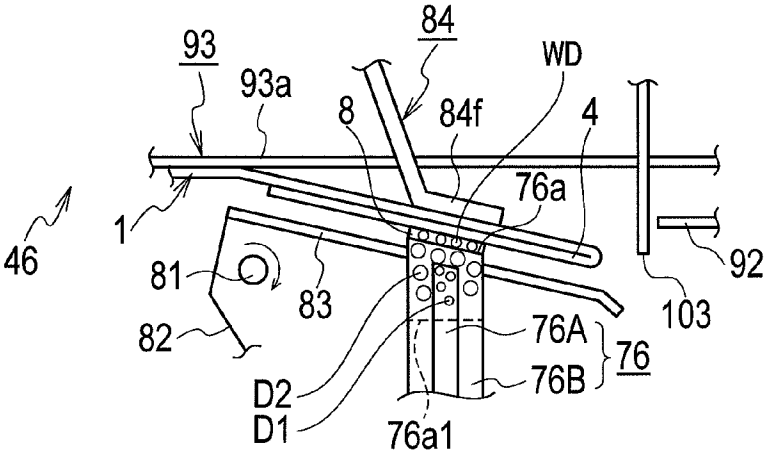

Next, in the water application state of FIG. 14C, when the predetermined time passes after the sheet sensor 46 senses the tip end of the envelope lower paper 4, and the fan-shaped cam 87 is rotated a half-turn from the standby position by the third motor 89, the moving guide plates 83 and the sheet pressing member 84 fixed to the moving bracket 82 are turned downward about the shaft 81. With this, the moving guide plates 83 enter the cutouts 76*a*1 formed on the upper edge 76*a* portion of the water application pad 76, and the sheet pressing parts 84*f* of the sheet pressing member 84 are moved below the lower plate 93*a* of the upper side sheet transfer guide plate 93 to press the remoistenable glue portion 8 previously attached to the envelope lower paper 4. Thus, the upper edge 76*a* of the water application pad 76 in which the first and second pad members 76A, 76B are allowed to contact each other comes in contact with the remoistenable glue portion 8.

Hence, the water 75 in the reservoir 74 is surely sucked up by the first pad member 76A including the pores having the small pore diameter D1 by capillary action, and the second pad member 76B including the pores having the large pore diameter D2 receives the water 75 sucked up by the first pad member 76A and applies the water 75 onto the remoistenable glue portion 8. With this configuration, an appropriate number of water drops having the large pore diameter D2 are automatically applied to the remoistenable glue portion 8 by the upper end 76*a* of the water application pad 76 covered with the second pad member 76B, and thus a favorable adhesion can be achieved. In FIG. 14C, WD indicates water drops applied by the pore diameter D2.

Figure 14D:
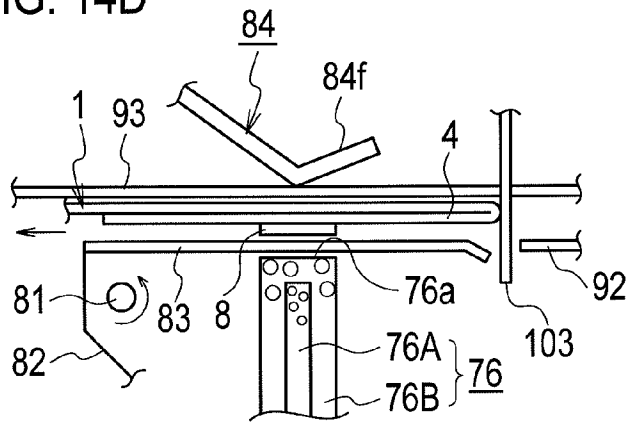

Next, in the water application completion state of FIG. 14D, when the fan-shaped cam 87 is rotated another half-turn from the water application position by the third motor 89, the moving guide plate 83 and the sheet pressing member 84 fixed to the moving bracket 82 are turned upward about the shaft 81 again and return to the envelope sheet standby position shown in FIG. 14A. Then, the envelope sheet 1 is transferred to a direction opposite to the direction in which the envelope sheet was received, so that a crease 2 is formed thereon.

The water application unit 70 of the embodiment of the invention has been described in detail by use of a case where the remoistenable glue portion 8 is previously attached to the predetermined adhesion position on the front face of the envelope lower paper 4 of the envelope sheet 1, and the water 75 is automatically applied to the remoistenable glue portion 8 by the water application pad 76. However, the invention is not limited to this, and is also applicable to a case where the remoistenable glue portion is previously attached to the flap portion of an envelope as mentioned in the related art.

The embodiment employs a configuration in which the sheet pressing member 84 is fixed to the moving bracket 82 and when the sheet pressing member 84 is turned to the water application position integrally with the moving bracket 82, the sheet pressing parts 84*f* of the sheet pressing member 84 press the envelope sheet 1 from above. However, the invention is not limited to this, and in an alternative applicable structural form, the water application pad 76 portion is moved up and down relative to the envelope sheet 1. In this case, the water application pad 76 can be raised to thereby press the envelope sheet 1 against the upper side sheet transfer guide plate 93. Accordingly, the moving bracket 82, the multiple moving guide plates 83 and the sheet pressing member 84 need not be provided, and it suffices that multiple guide plates for guiding the lower side of the envelope sheet 1 instead of the multiple moving guide plates 83 be fixedly installed upstream of the water application pad 76.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A water application unit comprising:

a reservoir configured to pool water;

a water application pad configured to apply the water pooled in the reservoir onto a remoistenable glue portion previously attached to an adhesion position on a sheet being transferred, wherein the water application pad comprises a first pad member disposed at a position to be immersed in the reservoir and including first pores for sucking up the water in the reservoir, and a second pad member disposed at a position to face the remoistenable glue portion while being in contact with the first pad member and including second pores for applying the water onto the remoistenable glue portion, the second pores having a diameter larger than a diameter of the first pores;

spacers; and a plurality of pad sandwiching plates configured to sandwich and hold the first pad member and the second pad member, and arranged via the spacers with a plurality of spaces from the second pad member at a portion toward an end of the second pad member for applying the water onto the remoistenable glue portion.

2. The water application unit according to claim 1, wherein when applying the water onto the remoistenable glue portion by the water application pad, an end of the first pad member for applying the water onto the remoistenable glue portion is separated from the remoistenable glue portion, while an end of the second pad member for applying the water onto the remoistenable glue portion comes in contact with the remoistenable glue portion.

* * * * *